US012543835B2

(12) United States Patent
Day et al.

(10) Patent No.: US 12,543,835 B2
(45) **Date of Patent: *Feb. 10, 2026**

(54) HEATED HAIR STRAIGHTENING ACCESSORY

(71) Applicant: SharkNinja Operating LLC, Needham, MA (US)

(72) Inventors: Michael Day, London (GB); Chris Hedges, Hampshire (GB); James Alexander Higson, Bristol (GB); Benjamin Robert Ellis Griffiths, Gloucestershire (GB)

(73) Assignee: SharkNinja Operating LLC, Needham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/741,534

(22) Filed: Jun. 12, 2024

(65) Prior Publication Data

US 2025/0380784 A1 Dec. 18, 2025

(51) Int. Cl.
*A45D 20/12* (2006.01)
*A45D 2/00* (2006.01)

(52) U.S. Cl.
CPC ..... *A45D 20/12* (2013.01); *A45D 2/001* (2013.01)

(58) Field of Classification Search
CPC ..... A45D 20/12; A45D 2/001
USPC ..... 132/212; 34/95–100
See application file for complete search history.

(56) References Cited

U.S. PATENT DOCUMENTS 686,994 A * 11/1901 Sonnen ..... A61L 2/06 604/24
1,765,380 A * 6/1930 Mcginnis ..... A45D 20/26 34/99
2,145,539 A * 1/1939 Bottorf ..... A45D 2/08 132/223
3,612,069 A 10/1971 Waters et al.
4,198,557 A 4/1980 Crowley
4,550,358 A 10/1985 Crowley et al.
4,896,021 A 1/1990 Poweleit et al.
(Continued)

FOREIGN PATENT DOCUMENTS

AU 2022422474 A1 * 6/2024 ..... A45D 1/04
CN 110269364 A 9/2019
(Continued)

*Primary Examiner* — Stephen M Gravini
(74) *Attorney, Agent, or Firm* — Mintz, Levin, Cohn, Ferris, Glovsky and Popeo, P.C.

(57) ABSTRACT

In one aspect, a hair care accessory is provided and in one embodiment can include an elongate body. The elongate body can include an appliance mating portion configured to removably couple the elongate body to a hair care appliance. The appliance mating portion can have an air inlet configured to receive airflow from the hair care appliance. The elongate body can also include a clamping portion having a first heater assembly, and a plurality of air outlets extending longitudinally there along. The hair care accessory can also include an arm coupled to the elongate body. The arm can have a second heater assembly. The arm can be movable between an open position in which the second heater assembly is spaced from the first heater assembly, and a closed position in which the first and second heater assemblies are configured to clamp hair therebetween.

20 Claims, 18 Drawing Sheets

(56) References Cited

U.S. PATENT DOCUMENTS

| | | | | |
|---|---|---|---|---|
| 5,149,209 | A | 9/1992 | Condrey et al. | |
| 5,568,691 | A * | 10/1996 | Rubin | A45D 20/30 392/380 |
| 6,703,587 | B2 | 3/2004 | Sena et al. | |
| 7,228,065 | B2 | 6/2007 | Cafaro | |
| 8,890,035 | B2 | 11/2014 | Scheunert et al. | |
| 9,414,662 | B2 * | 8/2016 | Moloney | A45D 20/00 |
| 9,961,979 | B2 | 5/2018 | Rodrigues | |
| 10,660,487 | B1 * | 5/2020 | Borja | A45D 20/16 |
| 11,259,615 | B2 * | 3/2022 | Liu | F04D 29/668 |
| 11,571,056 | B2 * | 2/2023 | Min | A45D 20/00 |
| 11,832,700 | B2 * | 12/2023 | Udy | A45D 20/10 |
| 11,844,408 | B2 * | 12/2023 | Kim | A45D 20/26 |
| 2023/0301415 | A1 * | 9/2023 | Soresina | A45D 20/10 |
| 2023/0346099 | A1 * | 11/2023 | Jiang | A45D 20/12 |
| 2024/0225233 | A1 | 7/2024 | Day et al. | |
| 2024/0245187 | A1 | 7/2024 | Phillips et al. | |
| 2024/0245188 | A1 | 7/2024 | Hedges et al. | |
| 2024/0245189 | A1 | 7/2024 | Thorpe et al. | |
| 2024/0245190 | A1 | 7/2024 | Higgins et al. | |
| 2024/0292934 | A1 * | 9/2024 | Zhang | A45D 2/001 |
| 2025/0057295 | A1 | 2/2025 | Forbes | |

FOREIGN PATENT DOCUMENTS

| | | | | |
|---|---|---|---|---|
| CN | 113229588 | B * | 6/2024 | A45D 20/10 |
| EP | 2684482 | A1 | 1/2014 | |
| GB | 2614547 | A | 7/2023 | |
| JP | 2023543849 | A * | 10/2021 | |
| WO | 2023131797 | A1 | 7/2023 | |
| WO | 2024155477 | A1 | 7/2024 | |

* cited by examiner

HEATED HAIR STRAIGHTENING ACCESSORY

FIELD

A hair care accessory for use with a hair care appliance is provided.

BACKGROUND

Hair care appliances are devices used for drying and styling of hair. Hair care appliances can include a variety of components operable to heat hair and to provide a fluid flow via a fluid flow path extending through the device. The fluid flow path receives ambient air and directs the ambient air through the hair care appliance via a motor and fan assembly. The fluid flow path is directed across a heater assembly to generate heated air at an outlet of the hair care appliance. Air is expelled from the hair care appliance via the fluid flow path to enable a user to dry or style hair. One or more attachable accessories are often used with the hair care appliance depending on the user's hair styling or treatment needs.

SUMMARY

In one aspect, a hair care accessory is provided and in one embodiment can include an elongate body. The elongate body can include an appliance mating portion configured to removably couple the elongate body to a hair care appliance. The appliance mating portion can have an air inlet configured to receive airflow from the hair care appliance. The elongate body can also include a clamping portion having a first heater assembly, and a plurality of air outlets extending longitudinally there along. The hair care accessory can also include an arm coupled to the elongate body. The arm can have a second heater assembly. The arm can be movable between an open position in which the second heater assembly is spaced from the first heater assembly, and a closed position in which the first and second heater assemblies are configured to clamp hair therebetween.

In some embodiments, the hair care accessory can also include a locking mechanism on at least one of the elongate body and the arm. The locking mechanism can have a locked position configured to retain the arm in the closed position and an unlocked position in which the arm is configured to move to the open position. In some embodiments, the locking mechanism can include an actuator positioned on a first surface of the arm, a hook positioned on a second surface of the arm opposite the first surface, and a protrusion extending from the arm and having a recess therein. In some embodiments, movement of the actuator to the locked position can be configured to cause the hook to be received in the recess.

In some embodiments, the hair care accessory can also include a biasing mechanism positioned between the elongate body and the arm and configured to bias the arm to the open position. In some embodiments, the elongate body can include first and second cavities extending longitudinally there through. In some embodiments, the elongate body further include a diverter downstream from the air inlet and configured to divert the airflow into the first cavity. In some embodiments, the air inlet can be positioned between the appliance mating portion and the clamping portion. In some embodiments, the appliance mating portion can include a collar having the air inlet positioned therein, the collar having mating features configured to engage with complementary mating features on the hair care appliance.

In another aspect, a hair care embodiment is provided and in one embodiment, can include an elongate body having first and second ends and a collar at a substantial mid-portion between the first and second ends. The collar can be configured to removably couple the elongate body to a hair care appliance and defining an air inlet configured to receive airflow from the hair care appliance. The elongate body can have a first heater assembly mounted thereon and a plurality of air outlets extending longitudinally toward the second end of the elongate body. The hair care accessory can also include an arm having first and second ends. The first end can be movably coupled to the first end of the elongate body. The arm can have a second heater assembly mounted thereon. The arm can be movable between an open position in which the second heater assembly is spaced from the first heater assembly, and a closed position in which the first and second heater assemblies are configured to clamp hair therebetween.

In some embodiments, the collar can be positioned within a hollow cylindrical shroud extending along a length of the substantial mid-portion of the elongate body. In some embodiments, the first heater assembly can be positioned on an inner facing surface of the elongate body between the substantial mid-portion and the second end, and the second heater assembly can be positioned on an inner facing surface of the arm between the substantial mid-portion and the second end of the arm. In some embodiments, the first heater assembly and the plurality of air outlets can extend substantially parallel to one another longitudinally along the elongate body. In some embodiments, the elongate body can have a cavity formed therein and extending from the first end along at least a portion thereof. The cavity can be configured to seat at least a portion of the arm when the arm is in the closed position.

In some embodiments, the plurality of air outlets in the elongate body can include a first plurality of air outlets and a second plurality of air outlets. In some embodiments, the first and second plurality of air outlets can be adjacent to one another and are configured to direct airflow in between the elongate body and the arm. In some embodiments, the hair care accessory can include a plurality of air inlets in the elongate body. The airflow from the first plurality of air outlets can be configured to draw airflow in through the plurality of air inlets and out the second plurality of air outlets. In some embodiments, the collar can include at least one electrical contact thereon configured to electrically couple to an electrical contact on the hair care appliance to allow power to be delivered to the first and second heater assemblies.

In some embodiments, the arm is substantially planar. In some embodiments, a width of a first portion of the arm extending from the first end to the substantial mid-portion is less than a width of a second portion of the arm extending from the substantial mid-portion to the second end.

In another aspect, a hair care accessory is provided and in one embodiment can include an elongate body having a collar configured to removably couple to a hair care appliance. The collar can define an air inlet configured to receive airflow from the hair care appliance. The elongate body can further include a first heater assembly and a plurality of air outlets extending longitudinally along the elongate body. The hair care accessory can also include an arm coupled to the elongate body. The arm can have a second heater assembly. The arm can be movable between an open position in which the second heater assembly is spaced from the first heater assembly, and a closed position in which the first and second heater assemblies are configured to clamp hair therebetween. The hair care accessory can further include a locking mechanism configured to releasably lock the arm in the closed position.

In some embodiments, the collar can be positioned at a substantial mid-point of the elongate body. In some embodiments, a length of the arm and a length of the elongate body can be substantially the same. In some embodiments, the arm can be biased to the open position, and the locking mechanism can include an actuator positioned on the arm and configured to release the arm from the closed position. In some embodiments, the collar can include at least one electrical contact thereon configured to electrically couple to an electrical contact on the hair care appliance to allow power to be delivered to the first and second heater assemblies. In some embodiments, the locking mechanism can include a latch configured to engage a catch to maintain the arm in the closed position. In some embodiments, the plurality of air outlets can include a first portion of air outlets fluidically coupled to the air inlet and a second portion of air outlets fluidically coupled to at least one second air inlet in the elongate body.

In some embodiments, the at least one second air inlet can be positioned on a first surface of the elongate body and the second portion of air outlets is positioned on a second surface of the elongate body opposite the first surface. The first portion of air outlets can be configured to entrain ambient air through the at least one second air inlet and out the second portion of air outlets. In some embodiments, the arm can be substantially planar and the elongate body has a hollow cylindrical shape around a substantial mid-portion thereof.

In another aspect, a hair care accessory is provided and in one embodiment can include an elongate body having a first end, a second end opposite the first end, and a collar positioned at a substantial mid-portion of the elongate body between the first and second ends. The collar can have an opening configured to receive an end of a hair care appliance therein, and the body can have a first heating plate. The hair care accessory can also include an arm having a first end pivotally mounted to the first end of the elongate body. The arm can have a second heating plate configured to be positioned adjacent to the first heating plate in a closed position. The arm can be movable via a biasing mechanism to an open position in which the second heating plate is spaced from the first heating plate.

In some embodiments, the biasing mechanism can include a compression spring extending between the first arm and to the second arm. In some embodiments, the arm can be configured to pivot relative to the elongate body about a pivot axis along an angle of between 0 and 45 degrees. In some embodiments, the hair care accessory can also include a locking mechanism configured to maintain the arm in a closed position in which the first and second heating plates are configured to clamp hair there between.

In some embodiments, the first heating plate can be configured in a first heater assembly on the elongate body and the second heating plates is configured in a second heater assembly on the arm. Each heater assembly can include a hair contacting surface on each heating plate, a heating element configured to receive power via the hair care appliance when the end of the hair care appliance is received within the collar, an elastic element supporting each heating plate, and a thermal fuse positioned between the heating plate and the heating element. In some embodiments, the elongate body include a hollow substantially cylindrical housing extending along at least a portion thereof, the collar being positioned within the hollow substantially cylindrical housing.

In another aspect, a hair care accessory is provided and in one embodiment can include an elongate body having a proximal portion, a distal portion, and a mating portion therebetween configured to mate with a hair care appliance. The mating portion can have a primary air inlet configured to receive a primary airflow from the hair care appliance. The distal portion can define a first arm extending from the primary air inlet. The first arm can have a first heater plate, a plurality of primary air outlets on a first surface of the first arm, a plurality of secondary air outlets on the first surface of the first arm, and at least one secondary air inlet on a second surface of the first arm opposite the first surface. The hair care accessory can also include a second arm coupled to the proximal portion of the elongate body and including a second heater plate on a first surface of the second arm facing the first surface of the first arm.

In some embodiments, the plurality of primary air outlets can be fluidically coupled to the primary air inlet via a first cavity extending longitudinally through the first arm. In some embodiments, the first cavity can be positioned downstream of the mating portion and can include a diverter adjacent to the primary air inlet configured to direct the primary airflow into the first cavity. In some embodiments, airflow from the plurality of primary air outlets can be configured to entrain air through the at least one secondary air inlet and out the plurality of secondary air outlets. In some embodiments, the plurality of primary air outlets can be fluidically coupled to the primary air inlet via a first cavity extending longitudinally through the first arm, and the plurality of secondary air outlets can be fluidically coupled to the at least one secondary air inlet via a second cavity extending longitudinally through the second arm. In some embodiments, the first cavity can be fluidically sealed from the second cavity.

In some embodiments, the plurality of primary air outlets can be substantially angled relative to the first surface of the first arm and the plurality of secondary air outlets are substantially normal relative to the first surface of the first arm. In some embodiments, a first portion of the at least one secondary air inlet can be positioned transversely to the plurality of primary air outlets with respect to a longitudinal axis of the first arm. In some embodiments, the plurality of primary air outlets can extend along the first surface of the first arm parallel to the plurality of secondary air outlets extending along the first surface of the first arm. In some embodiments, the plurality of primary and secondary air outlets can extend along the first surface of the first arm adjacent and parallel to the first heater plate. In some embodiments, the plurality of primary air outlets can be configured to direct the airflow therefrom along a length of hair retained between the first and second heater plates.

In another aspect, a hair care accessory is provided and in one embodiment can include an elongate body. The elongate body can include a collar configured to removably couple to a hair care appliance. The collar can define a primary air inlet configured to receive a primary airflow from the hair care appliance. The elongate body can also include a primary cavity extending through the elongate body between the primary air inlet and at least one primary air outlet positioned on a first surface of the elongate body. The elongate body can further include a secondary cavity fluidically separated from the primary cavity. The secondary cavity can extend between at least one secondary air inlet positioned on a second surface of the elongate body opposite the first surface and at least one secondary air outlet. The elongate body can also include a first heater assembly. The hair care accessory can also include an arm movably coupled to the elongate body and having a second heater assembly configured to be positioned adjacent to the first heater assembly for clamping hair therebetween.

In some embodiments, the at least one secondary air inlet can be positioned on the elongate body opposite to the first heater, and the at least one secondary air outlet can be positioned adjacent and parallel to the first heater. In some embodiments, the secondary cavity can convey wiring coupling a plurality of electrical contacts positioned in the collar and can be configured to receive power signals from the hair care appliance to the first heater assembly. In some embodiments, the at least one secondary air inlet can be configured to allow secondary airflow of ambient air into the secondary cavity as a result of the primary airflow exiting the at least one primary outlet. In some embodiments, the secondary airflow can be configured to cool the second surface of the elongate body.

In some embodiments, the secondary cavity can include at least one wall formed by the second surface of the elongate body. In some embodiments, the secondary cavity can include at least one wall formed by a wall of the primary cavity. In some embodiments, the secondary cavity can extend under the primary cavity in proximity to the at least one secondary air outlet relative a longitudinal axis extending through the primary cavity.

In another aspect, a hair care accessory is provided and in one embodiment can include a body having a mating portion configured to be removably mounted on a hair dryer. The mating portion can be configured to mate with a hair care appliance and can have an opening defining an air inlet configured to receive airflow from the hair care appliance and to provide the airflow to a plurality of outlets formed in the body. The opening can have a collar therearound with a plurality of electrical contacts configured to allow power signals to be received by the body from the hair care appliance. The body can have an arm movably coupled thereto. The body and the arm can each have a heater assembly thereon. The heater assemblies can be configured to clamp hair there between, and each heater assembly can be electrically coupled to the electrical contacts for heating clamped hair.

In some embodiments, the plurality of electrical contacts can be positioned on a first end of the mating portion and extend though the mating portion to electrically couple with an annular connector board positioned at a second end of the mating portion opposite the first end. In some embodiments, the heater assembly of the body can be electrically coupled to a first portion of the annular connector board via first wiring and the heater assembly of the arm can be electrically coupled to a second portion of the annular connector board via second wiring. In some embodiments, the first wiring can be routed to the heater assembly of the body below a longitudinal axis extending through a center of the mating portion and the second wiring can be routed to the heater assembly of the arm above the longitudinal axis extending through the center of the mating portion. In some embodiments, the heater assemblies can include a hair contacting surface having a coating thereon including a thermally conductive material.

In another aspect, a hair care accessory is provided and in one embodiment can include an elongate body having an appliance mating portion configured to removably couple the elongate body to a hair care appliance. The appliance mating portion can have an air inlet configured to receive airflow from the hair care appliance and a plurality of electrical contacts. The elongate body can have a first heater assembly coupled to the plurality of electrical contacts via wiring, and the elongate body can have a plurality of air outlets. The hair care accessory can also include an arm movably coupled to the elongate body. The arm can have a second heater assembly configured to be positioned adjacent to the first heater assembly for clamping hair therebetween. The hair care accessory can further include a conduit extending between the elongate body and the arm and having wiring extending therethrough coupling the electrical contacts to the second heater assembly.

In some embodiments, the elongate body can include a first protrusion extending toward the arm and having an opening therein and the arm can include a recess from which the conduit projects toward the elongate body. The conduit can be configured to slidably translate within the opening of the first protrusion. In some embodiments, the first protrusion can be received within the recess of the arm in a closed position in which the first and second heater assemblies are positioned adjacent to one another. In some embodiments, the conduit can be configured to slidably translate relative to the elongate body between an open position in which the arm is spaced apart from the elongate body and a closed position in which the first and second heater assemblies are positioned adjacent to one another.

In some embodiments, the conduit can include a first end positioned in the arm and a second end opposite the first end. The first end can include a first flange securing the first end of the conduit within the arm and the second end including a second flange configured to maintain the conduit within the elongate body. In some embodiments, the conduit can be received within a cavity of a frame positioned between the first heater assembly and the appliance mating portion. In some embodiments, the frame can include a projection extending into the cavity body cavity includes a projection configured to limit translation of the conduit into the elongate body. In some embodiments, the conduit can be positioned at a substantial mid-point of the elongate body and can extend vertically between the elongate body and the arm relative to a longitudinal axis extending centrally through the appliance mating portion.

DESCRIPTION OF DRAWINGS

These and other features will be more readily understood from the following detailed description taken in conjunction with the accompanying drawings, in which.

Figure 1A:
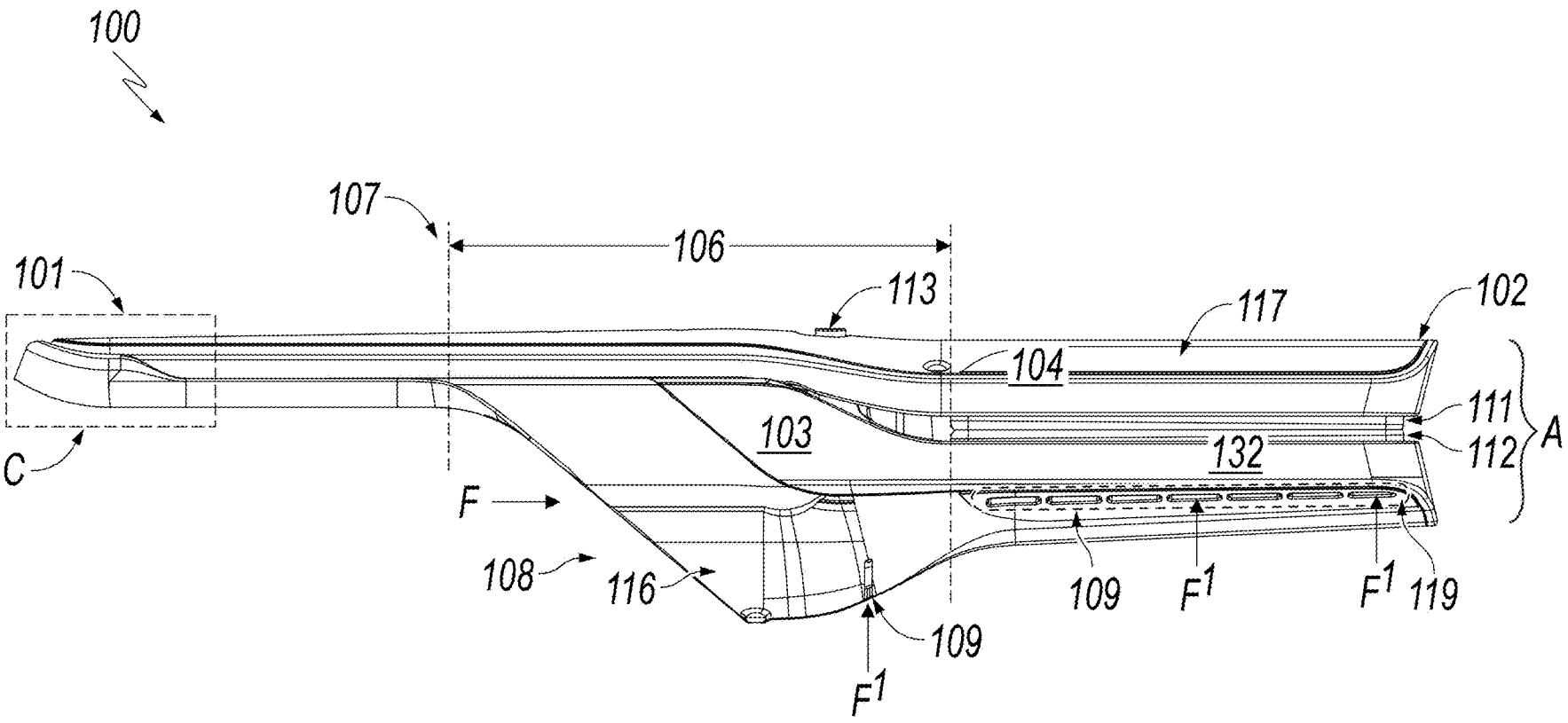
FIG. 1A is a first side view of one exemplary embodiment of a heated hair straightening accessory shown in a closed position.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Various exemplary hair care appliances and accessories for use with a hair care appliance are provided herein. In general, the hair care appliance is in the form of a hair dryer that has an air inlet and at least one air outlet, and various internal components that facilitate use and operation of the hair care appliance, such as a fan, motor, and heater. Various accessories are also provided for use with a hair care appliance, and the configuration of the appliance can be varied based on the type of accessory mated to the hair care appliance.

The heated hair straightening accessory (HHSA) described herein can be configured to straighten hair. Hair straightening can involve applying heat and/or an airflow along a length of hair for the purpose of removing curls, kinks, bends, or waves from the hair to produce lengths of hair that are as straight as possible. Often hair straightening devices require significant manual dexterity to position the hair therein and apply the desired heat or airflow settings. Many existing hair straightening devices lack the ability to provide an airflow for hair drying purposes, which can require the use of two separate devices for drying/heating and straightening hair.

The HHSA described herein can couple to a hair care appliance, such as a hair dryer, and receive an airflow from the hair care appliance. The HHSA can include heated plates that can be configured on an arm portions of the HHSA. The heated plates can heat hair retained therebetween for drying and styling of hair, particularly for straightening hair. The HHSA can also include an arrangement of air inlets and air outlets configured to provide an airflow over hair retained between the heated plates while maintaining a surface temperature of the HHSA at an acceptable temperature for manual handling by a user. The arm portions of the HHSA can be movable, via a biasing mechanism, between an open position in which hair can be inserted between the heated plates and a closed position in which hair can be retained between adjacent heated plates. A locking mechanism can secure one arm portion adjacent to another arm portion in the closed position. Advantageously, the HHSA described herein can provide an enhanced user experience for drying and straightening hair. The improved HHSA and features thereof described herein can enhance the overall styling experience, regardless of user skill, and in particular, can provide improved hair straightening results compared to existing heated hair straightening devices and reduce the number of hair styling devices required to achieve a desired hair style.

FIGS. 1A-1D illustrate one exemplary embodiment of a HHSA 100. The illustrated HHSA 100 can have a closed position A shown in FIGS. 1A-1B and an open position B shown in FIGS. 1C-1D. As shown, the HHSA 100 generally includes a first end 101, which can be understood to be a proximal end of the HHSA 100 and a second end 102, which can be understood to be a distal end of the HHSA 100. The HHSA can include an elongate body 103 and an arm 104 extending between the first end 101 and the second end 102. The first and second ends 101, 102 can correspond to respective ends of the elongate body 103 and the arm 104.

Figure 1B:
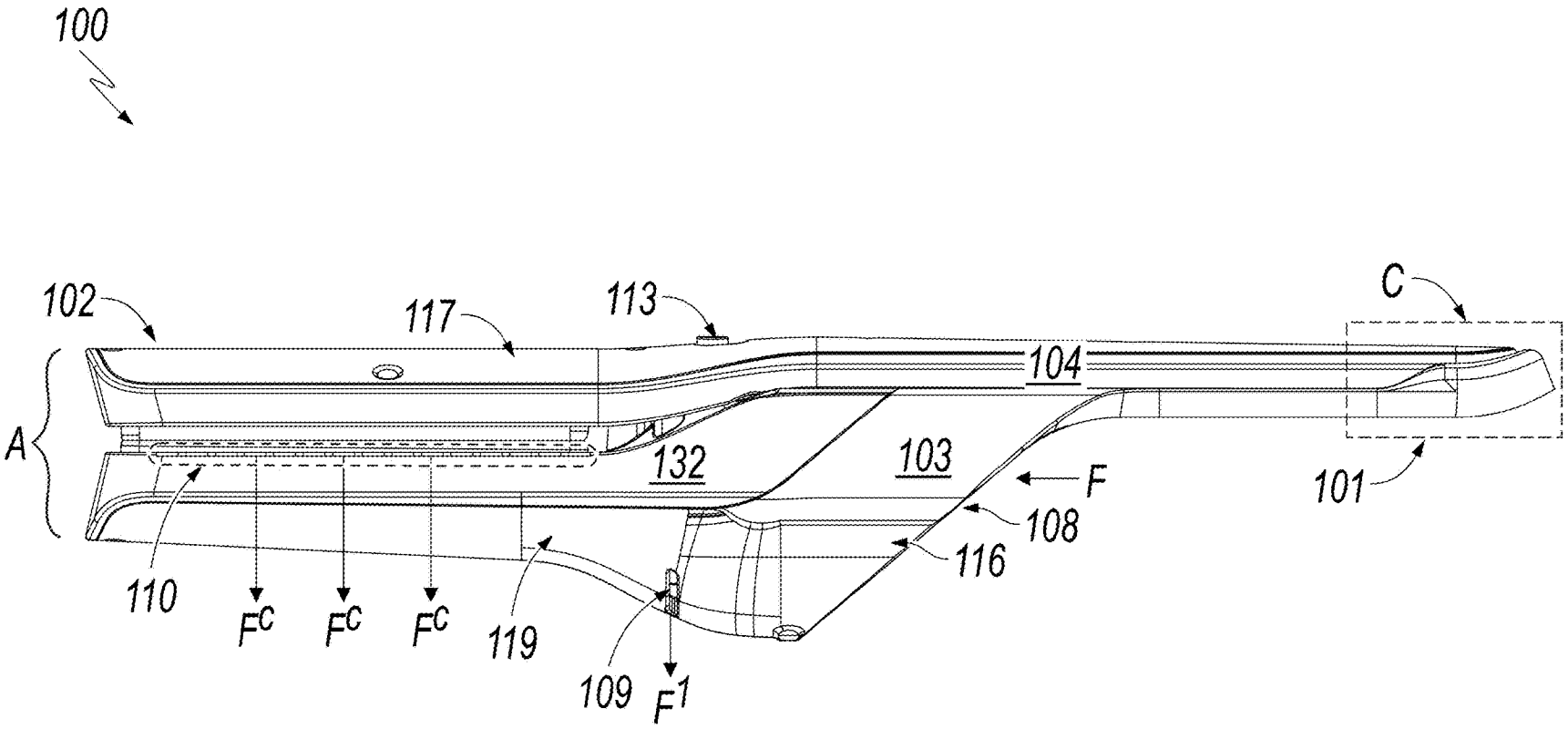
FIG. 1B is a second side view of the heated hair straightening accessory of FIG. 1A in the closed position.
Figure 1C:
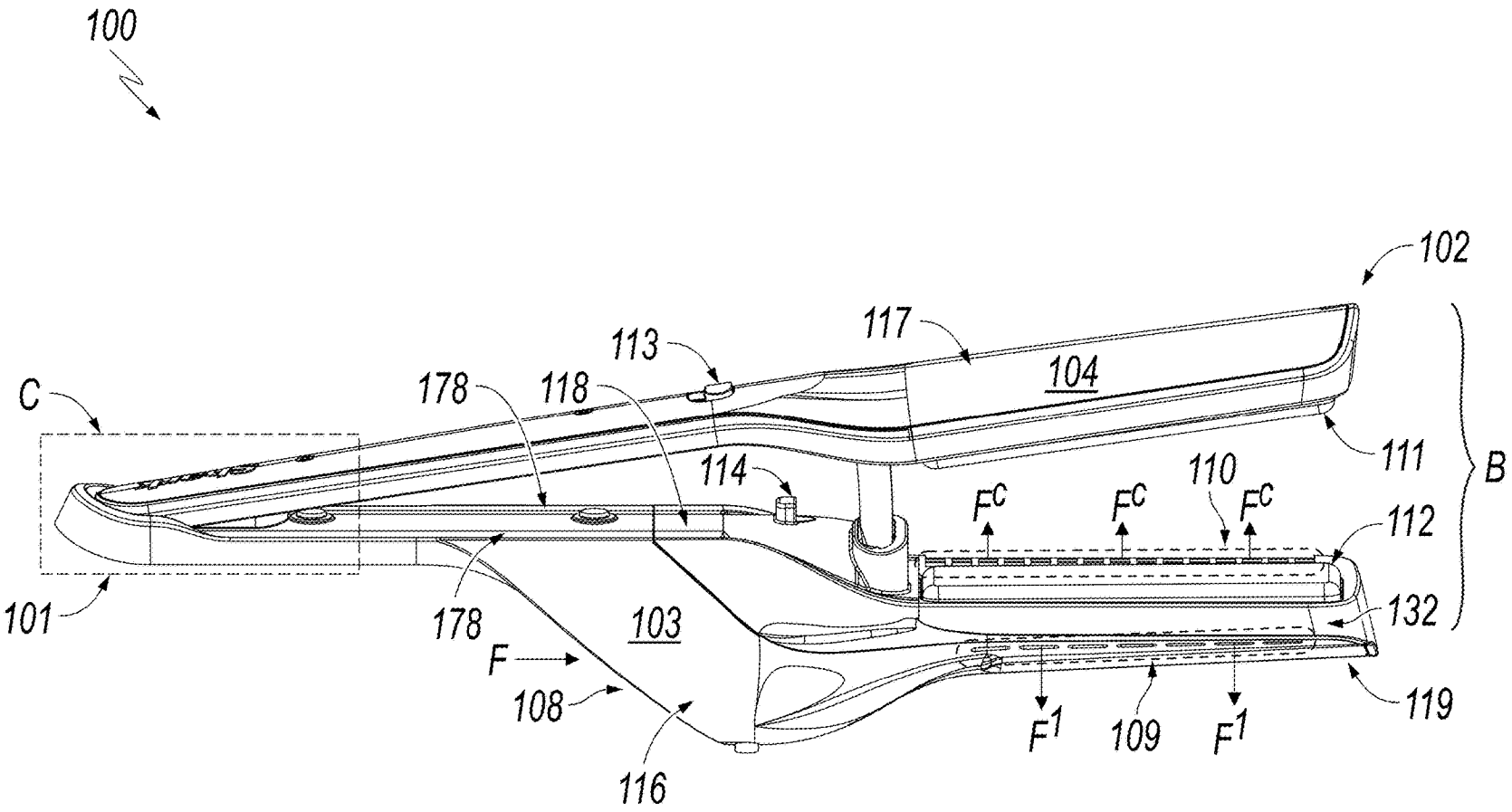
FIG. 1C is a first side view of the heated hair straightening accessory of FIG. 1A in an open position.
Figure 1D:
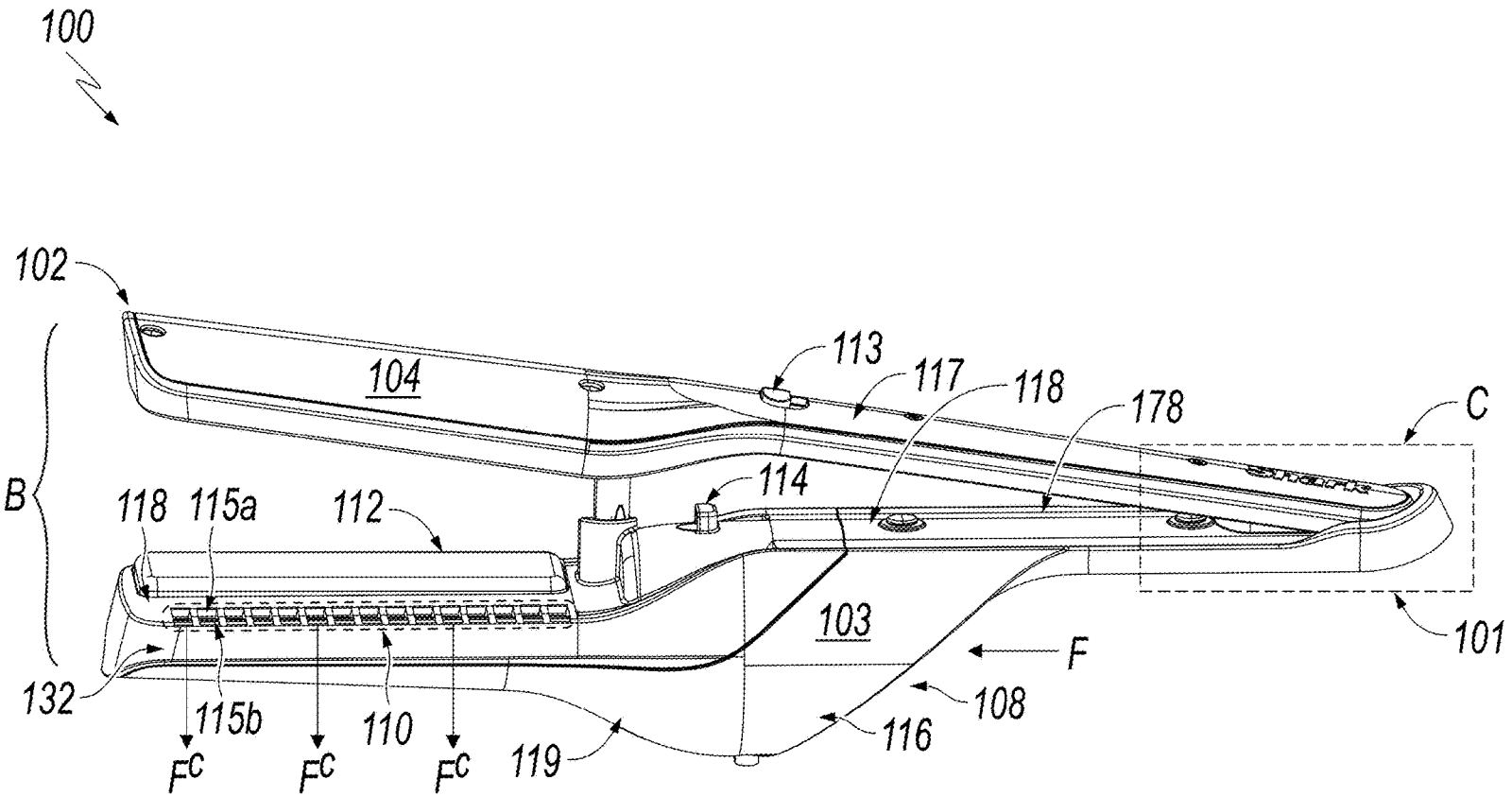
FIG. 1D is a second side view of the heated hair straightening accessory of FIG. 1C in the open position.

The HHSA 100 can include a clamping portion 105 (also understood to be a distal portion 105 of the HHSA 100), a mating portion 106, and a proximal portion 107 as shown in FIG. 1A. Hair can be retained within the clamping portion 105 when the HHSA is in the closed position A. The mating portion 106 can be configured at a substantial mid-portion of the elongate body 103 and can receive an air outlet end of a hair care accessory therein. The arm 104 can be coupled to the elongate body 103 in the proximal portion 107. The elongate body 103 can have a substantially elongate portion extending from the first end 101 toward the mating portion 106, at which the elongate body 103 can transition to a substantially cylindrical shape formed by a shroud 116. The elongate body 103 can include one or more cavities or channels 178 extending from the first end 101 along at least a portion thereof as shown in FIGS. 1C-1D. The cavities 178 can be configured to receive or seat a portion of the arm 104 when the arm 104 is moved to the closed position A shown in FIGS. 1A-1B.

Figure 11:
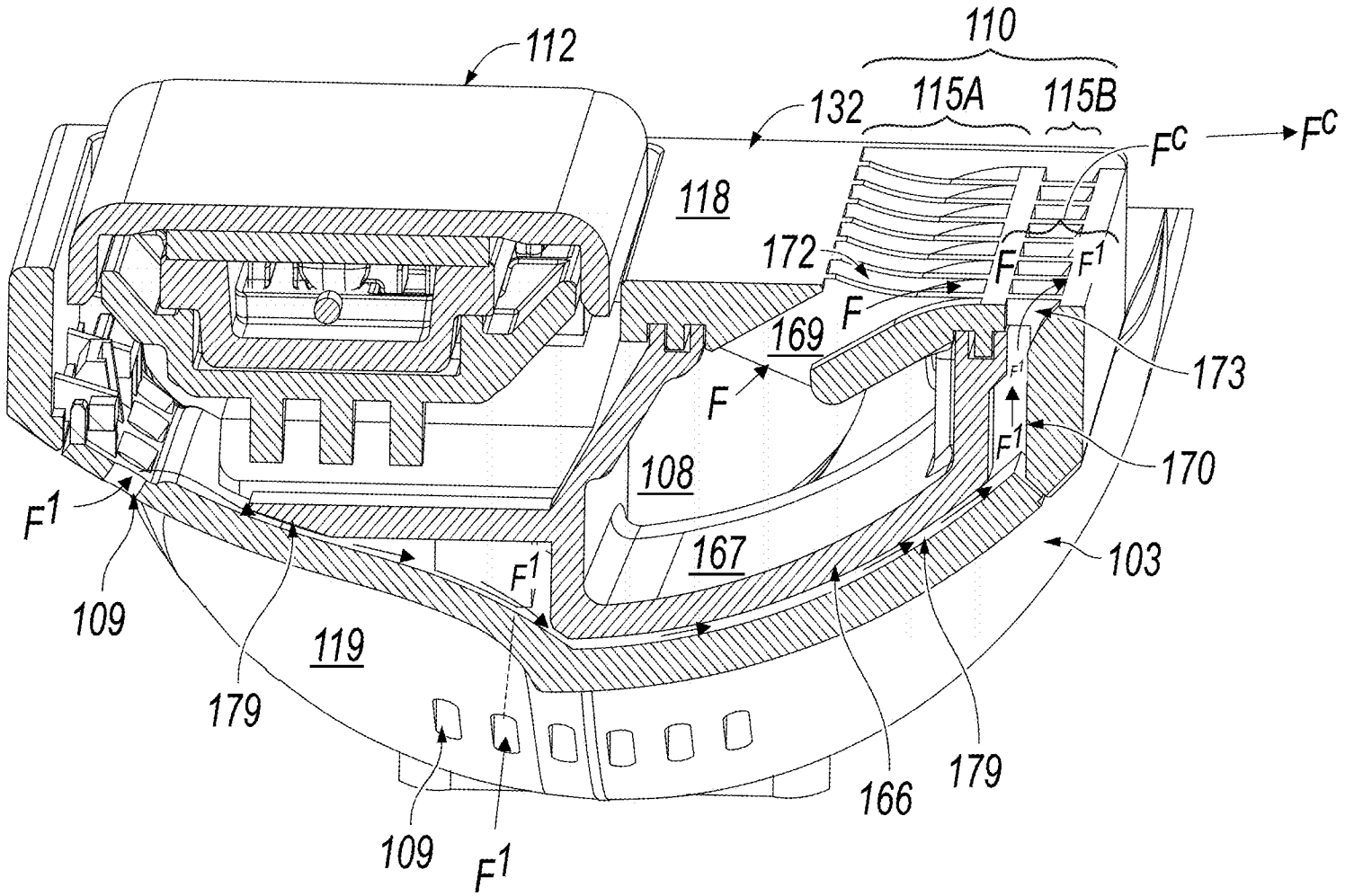
FIG. 11 is a detailed view of the cross-sectional front view of FIG. 10 illustrating the directions of airflow provided via the plurality of air outlets extending along the arm of the elongate body.
Figure 12:
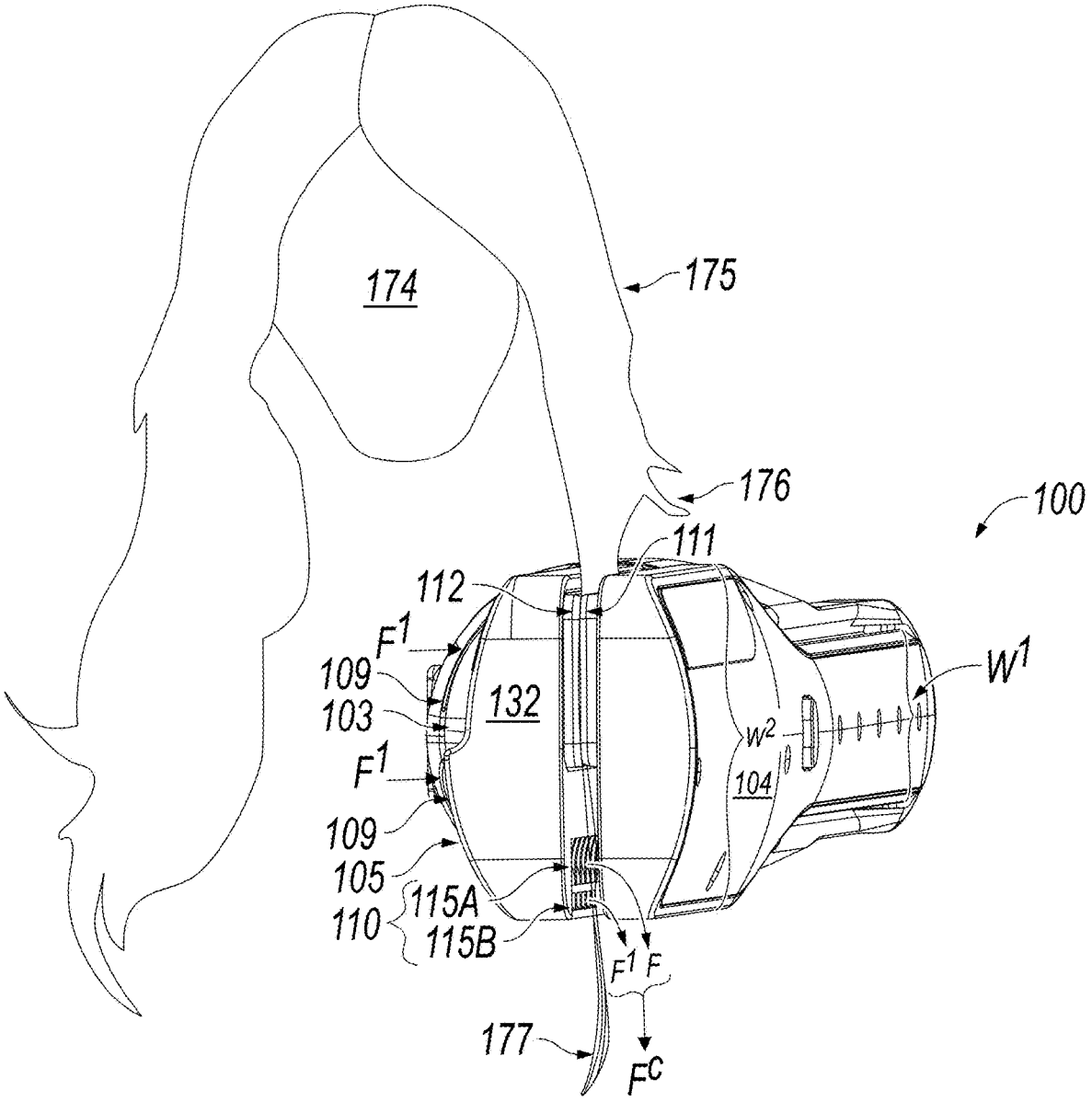
FIG. 12 is a diagram illustrating use of the heated hair straightening accessory of FIGS. 1A-1D styling hair.

The shroud 116 can have a substantially cylindrical shape and can form a hollow substantially cylindrical housing. The elongate body 103 can include an arm 132 extending from the mating portion 106. The elongate body 103 can transition to a substantially planar shape in the clamping portion 105. The arm 104 can have a substantially elongate shape extending from first end 101 toward the mating portion 106 at which the shape can transition to a substantially planar shape as the arm 104 extends toward the clamping portion 105. Thus, a first portion of the arm 104 within the proximal portion 107 can have a width W1 that is less than a width W2 of the arm 104 extending toward the clamping portion 105 as shown in FIG. 11.

The elongate body 103 and the arm 104 can each include a heater assembly configured at the second end 102 thereof. For example, as shown in FIGS. 1A-C, the arm 132 of the elongate body 103 can include a first heater assembly 112 and the arm 104 can include a second heater assembly 111 arranged within the clamping portion 105. The heater assemblies 111, 112 can include a heated hair contacting surface configured to heat hair retained between the heater assemblies 111, 112 in the closed position A shown in FIGS. 1A-1B. In some embodiments, the heater assemblies 111, 112 can be configured as "floating" heater assemblies that are retained within the arms 104, 132, but not fixedly held in place, as described further below.

The arm 104 can be coupled to the elongate body 104 at the first end 101 within a biasing portion C as shown in FIGS. 1A-1D. The biasing portion C can include a biasing mechanism configured therein to articulate the arm 104 away from the elongate body 103. In this way, the arm 104 can translate relative to the elongate body 103 from the closed position A shown in FIGS. 1A-1B to the open position B shown in FIGS. 1C-1D. In some embodiments, the biasing portion C can be configured so that the arm 104 is biased in an open position (e.g., the open position B) relative to the elongate body 103, such that closing the arm 104 requires applying grip pressure to the arm 104, as described further below.

Figure 2A:
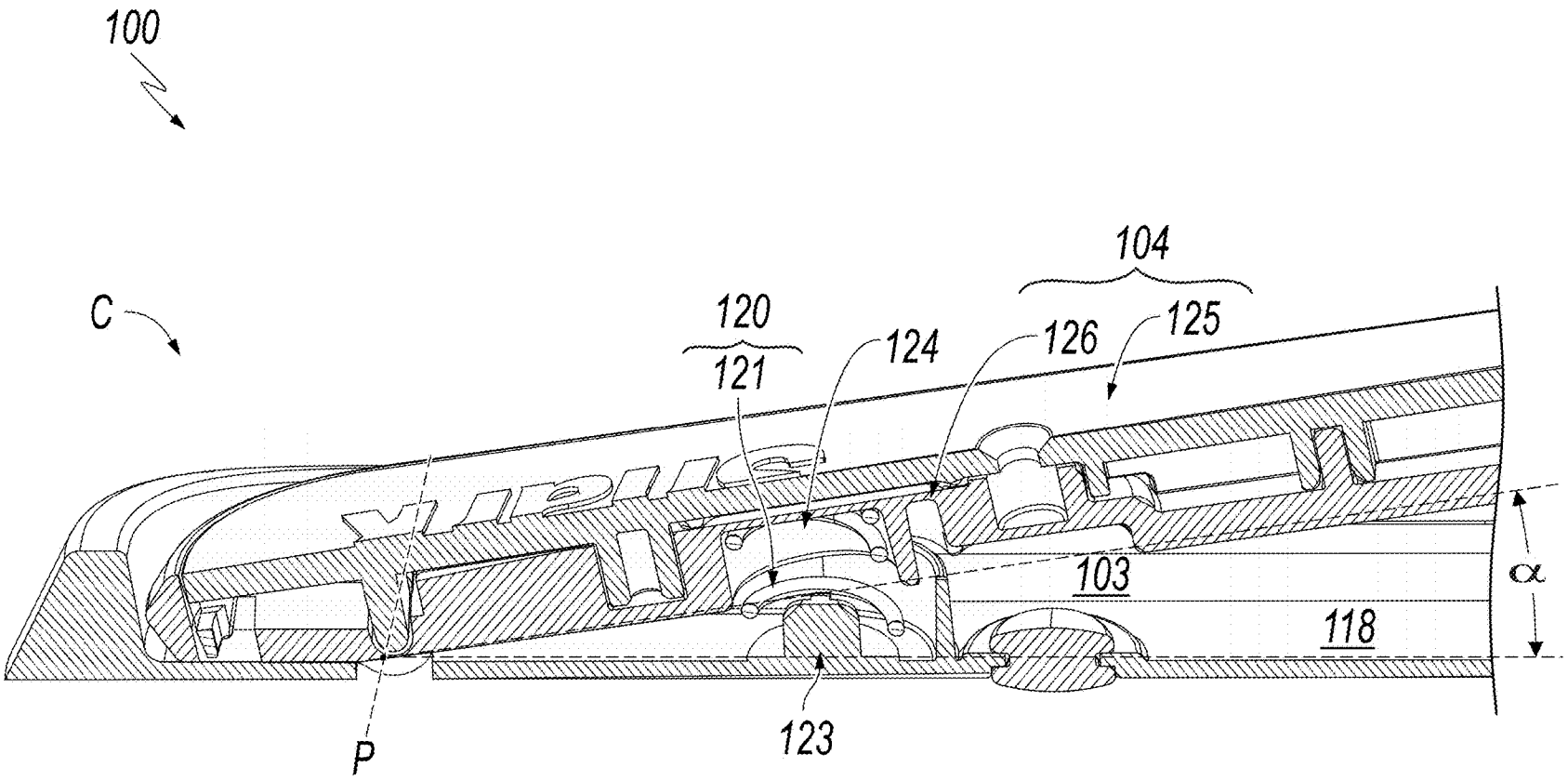
FIG. 2A is a cross-sectional side view of a biasing portion of the heated hair straightening accessory of FIGS. 1A-1D.
Figure 2B:
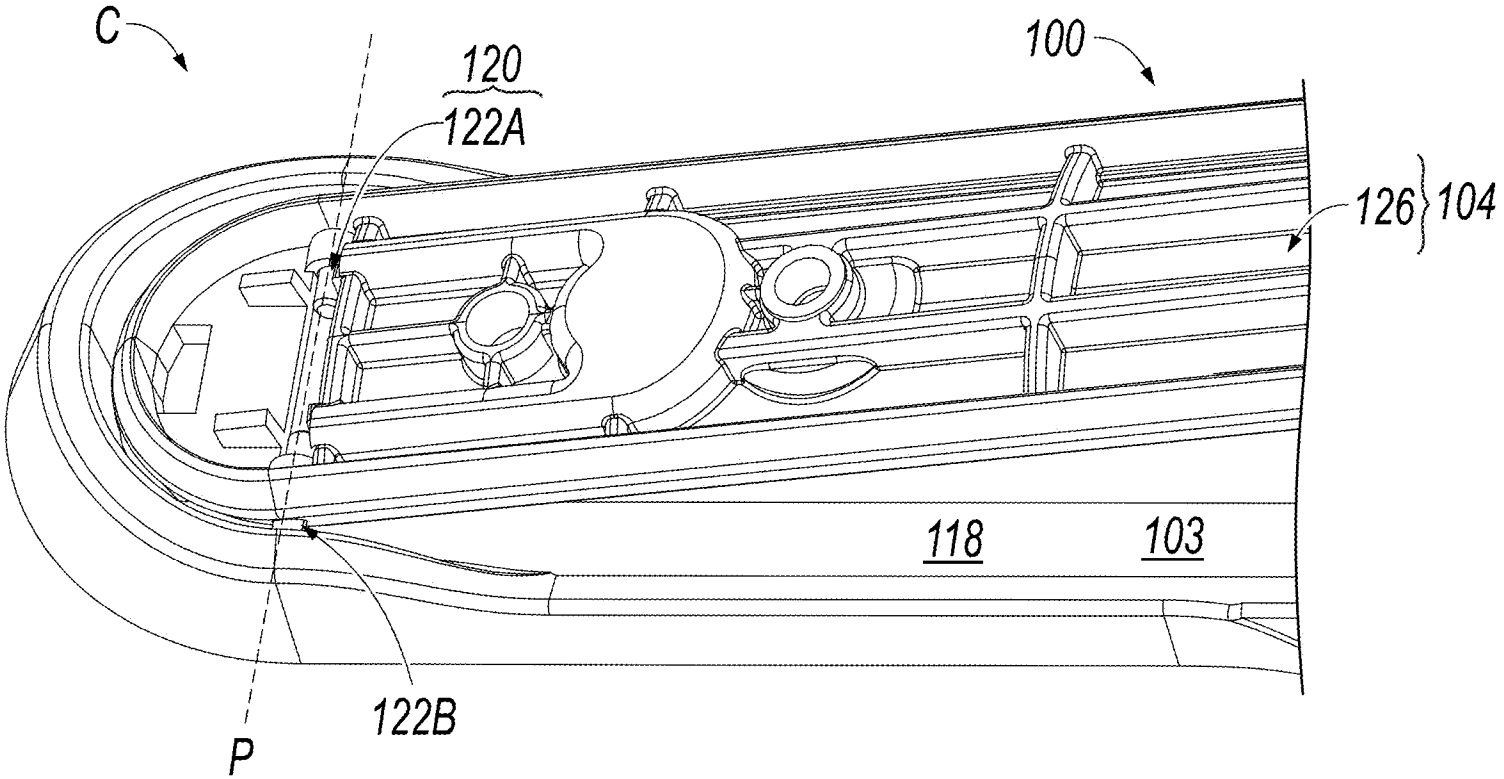
FIG. 2B is a detailed view of a biasing portion of the heated hair straightening accessory of FIGS. 1A-1D shown with a cover of the arm removed.

As shown in FIGS. 2A-2B, the biasing mechanism 120 configured within the biasing portion C can include a compression spring 121 as shown in the cross-sectional view of FIG. 2A and at least one pin 122 as shown in FIG. 2B. The compression spring 121 can be coupled at a first end to a protrusion 123 extending from the first surface 118 of the elongate body and to the arm 104 at a second end of the compression spring 121. The arm 104 can include a cover 125 and a frame 126. The second end of the spring 121 can be received within a recess 124 of the frame 126. The arm 104 can be pivotably coupled to the elongate body 103 via at least one pin 122. As shown in FIG. 2B, the cover 125 has been removed so that the pins 122A and 122B are more clearly shown. The pins 122A and 122B can extend through opposing sides of the frame 126. The opposing ends of the pins 122A and 122B can be received within corresponding openings of the elongate body 103. In some embodiments, a single pin 122 can extend through the arm 104 (or the frame 126) such that opposing ends of the pin 122 can be received within the elongate body 103. The compression spring 121 can exert a force against the elongate body 103 toward the arm 104 to cause the arm 104 to translate away from the elongate body 103 and into the open position A shown in FIGS. 1C-1D and 2A-2B. The arm 104 can pivot about a pivot axis P extending through the pins 122. The arm 104 can be configured to pivot relative to the elongate body 103 about pivot axis P at an angle $\alpha$ that can be between approximately 0 degrees (e.g., the closed position A) and any maximum angle suitable for a strand of hair to be received therebetween, such as an angle $\alpha$ between about 0-5 degrees, 0-10 degrees, 0-15 degrees, 0-20 degrees, 0-25 degrees, 0-30 degrees, 0-35 degrees, 0-40 degrees, 0-45 degrees, 0-50 degrees, 0-55 degrees, or 0-60 degrees. In some embodiments, the angle $\alpha$ can preferably be about 10 degrees or can be 10 degrees. In some embodiments, during assembly the angle $\alpha$ can be between about 0-10 degrees, 0-15 degrees, 0-20 degrees, 0-25 degrees, 0-30 degrees, 0-35 degrees, 0-40 degrees, 0-45 degrees, 0-50 degrees, 0-55 degrees, or 0-60 degrees. In some embodiments, during assembly the angle $\alpha$ can preferably be 30 degrees.

A user can retain the arm 104 in the closed position A by actuating a locking mechanism 113 provided on a first surface 117 of the arm 104. The locking mechanism 113 can be configured to engage a catch 114 positioned on the first surface 118 of the elongate body 103 as shown in FIGS. 1C-1D. A user may actuate the locking mechanism 113 to secure the arm 104 adjacent to the elongate body 103 in the closed position A for travel or storage purposes.

Figure 3A:
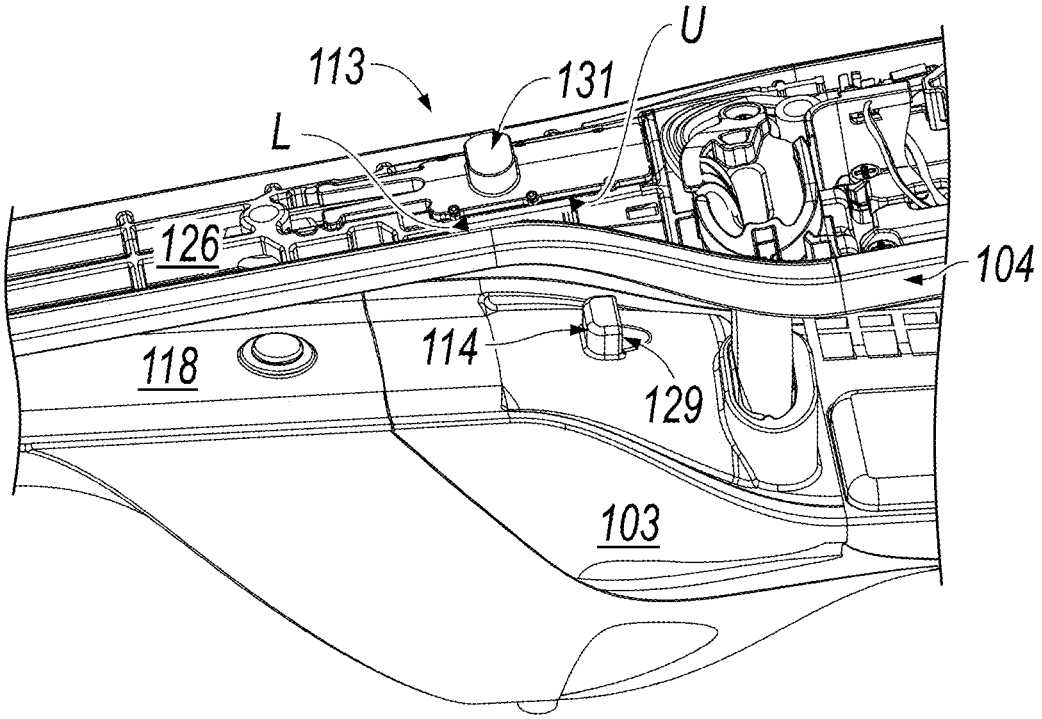
FIG. 3A is a detailed view of an actuator of a locking mechanism of the heated hair straightening accessory of FIGS. 1A-1D shown with a cover of the arm removed.
Figure 3B:
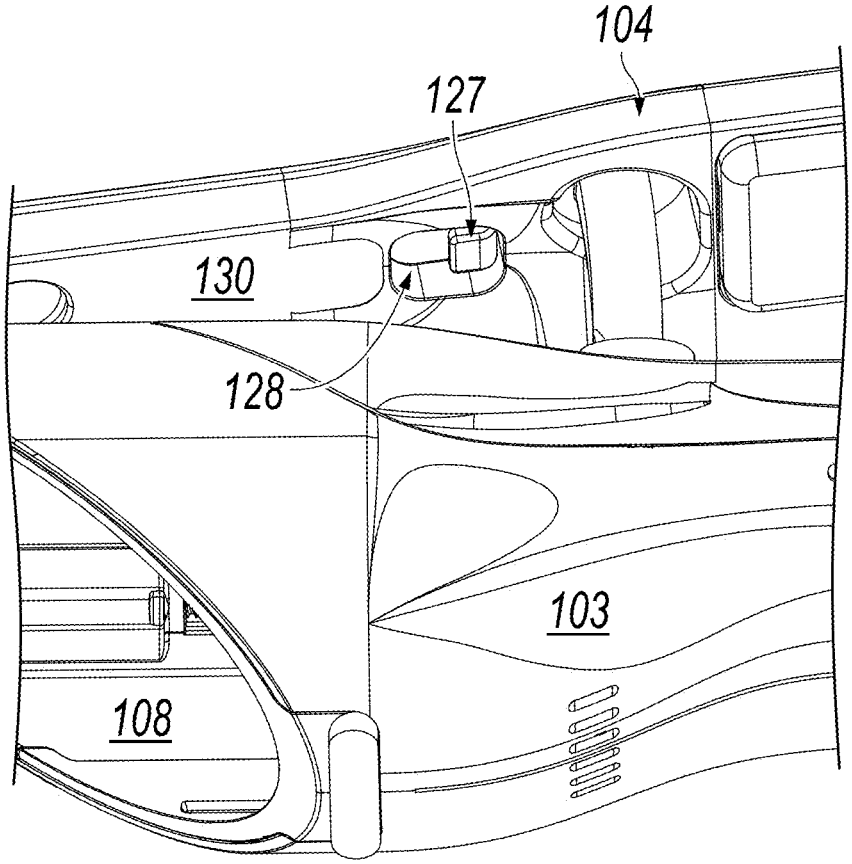
FIG. 3B is a perspective view of a catch of the locking mechanism of the heated hair straightening accessory of FIGS. 1A-1D.

With reference to FIGS. 3A and 3B, the locking mechanism 113 can include an actuator 131 positioned within the arm 104 at a substantial mid-portion of the elongate body, for example within the mating portion 106 shown in FIG. 1A. As shown in FIG. 3A, the actuator 131 can be configured to slidably translate toward the first end 101 of the arm 104 in a locked position L and toward the second end 102 of the arm 104 in an unlocked position U. The actuator 131 can include a latch 127 as shown in FIG. 3B. The latch 127 can have a hook-shape and can be positioned within a recess 128 formed within a second surface 130 of the arm 104. The catch 114 can be received within the recess 128 when the arm 104 is translated into contact with the elongate body 103 in the closed position A. The latch 127 can be received within a cavity 129 formed within the catch 114 when the actuator 131 is translated to the locked position L. With the actuator 131 engaged in the locked position L, the HHSA 100 can be secured in the closed position A shown in FIGS. 1A-1B. Moving the actuator 131 to the unlocked position U, the arm 104 can translate away from the elongate body 103 into the open position B shown in FIGS. 1C-1D.

Figure 4:
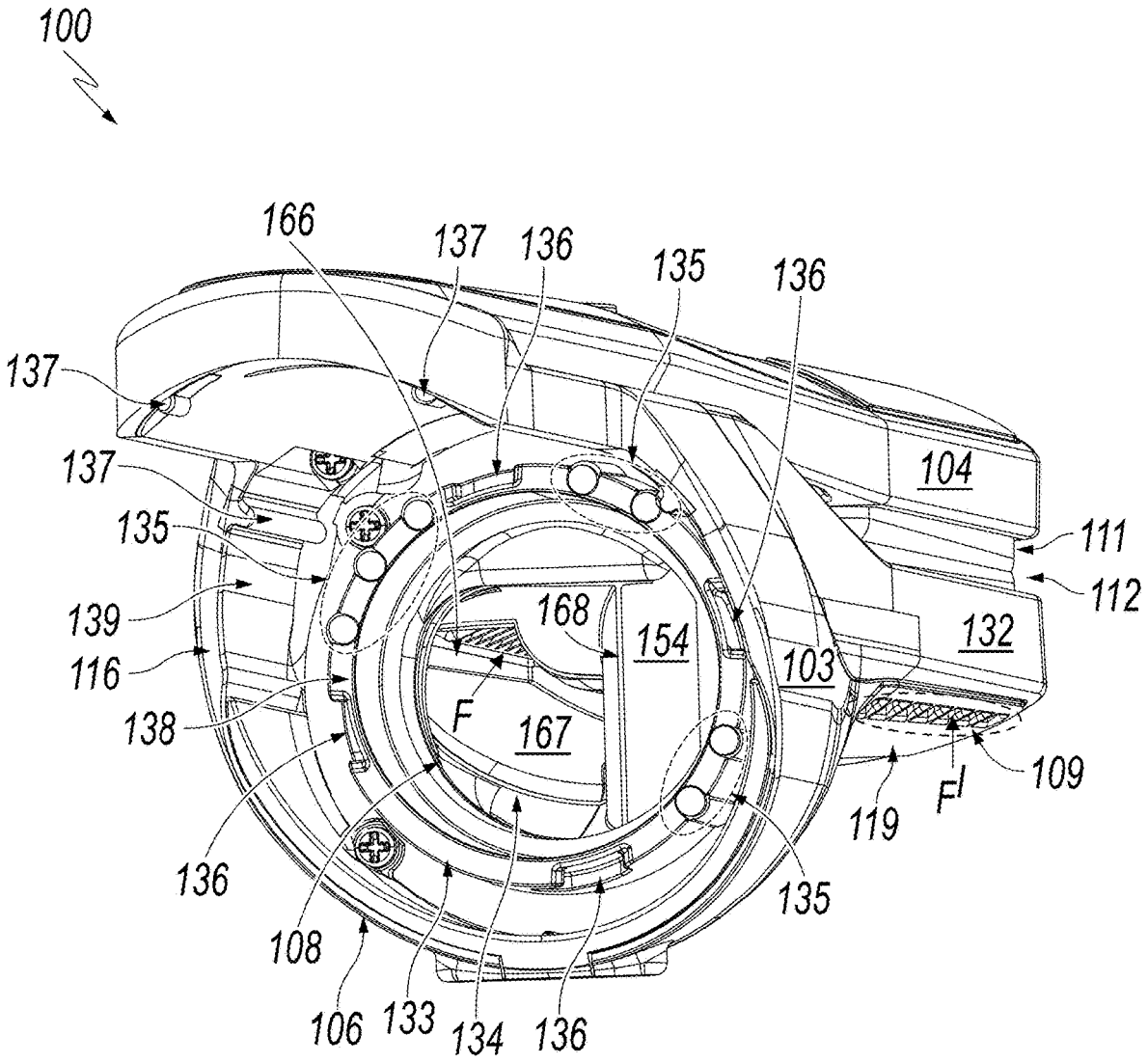
FIG. 4 is a rear perspective view of a mating portion of the heated hair straightening accessory of FIGS. 1A-1D.

FIG. 4 illustrates a perspective view of the mating portion 106. The mating portion 106 can include a collar 133 with an opening 134 provided therethrough. The opening 134 can form the air inlet 108 at which airflow Fis received from a hair care appliance when the HHSA 100 is coupled thereto. The collar 133 can include a plurality of electrical contacts 135 configured about a circumference of a first end 138 of the collar 133. The electrical contacts 135 can be configured to electrically couple with corresponding electrical contacts provided at the air outlet end of the hair care appliance when the HHSA 100 is coupled to the hair care appliance. The electrical contacts 135 can convey power signals from the hair care appliance to the heater assemblies 111 and 112 configured on arms 104 and 132.

The collar 133 can also include one or more slots 136 configured around the circumference of the collar 133 on an outer surface thereof. The slots 136 can be configured to receive corresponding protrusions or similar attachment mechanism provided on the air outlet end of the hair care appliance. The slots 136 can include an angled portion configured to secure the corresponding protrusions of the hair care appliance therein responsive to the protrusions being rotated within the 136. In some embodiments, the protrusions of the hair care appliance can be friction fit within the slots 136. The mating portion 106 can also include one or more ribs 137 arranged on an inner surface 139 of the shroud 116. The ribs 137 can protrude from the inner surface 139 to engage with a substantially cylindrical housing of the hair care appliance when coupled to the HHSA 100 and to reduce lateral displacement of the HHSA 100 relative to the air outlet end of the hair care appliance. In some embodiments, the ribs 137 can include a rubber or silicone material.

Figure 5A:
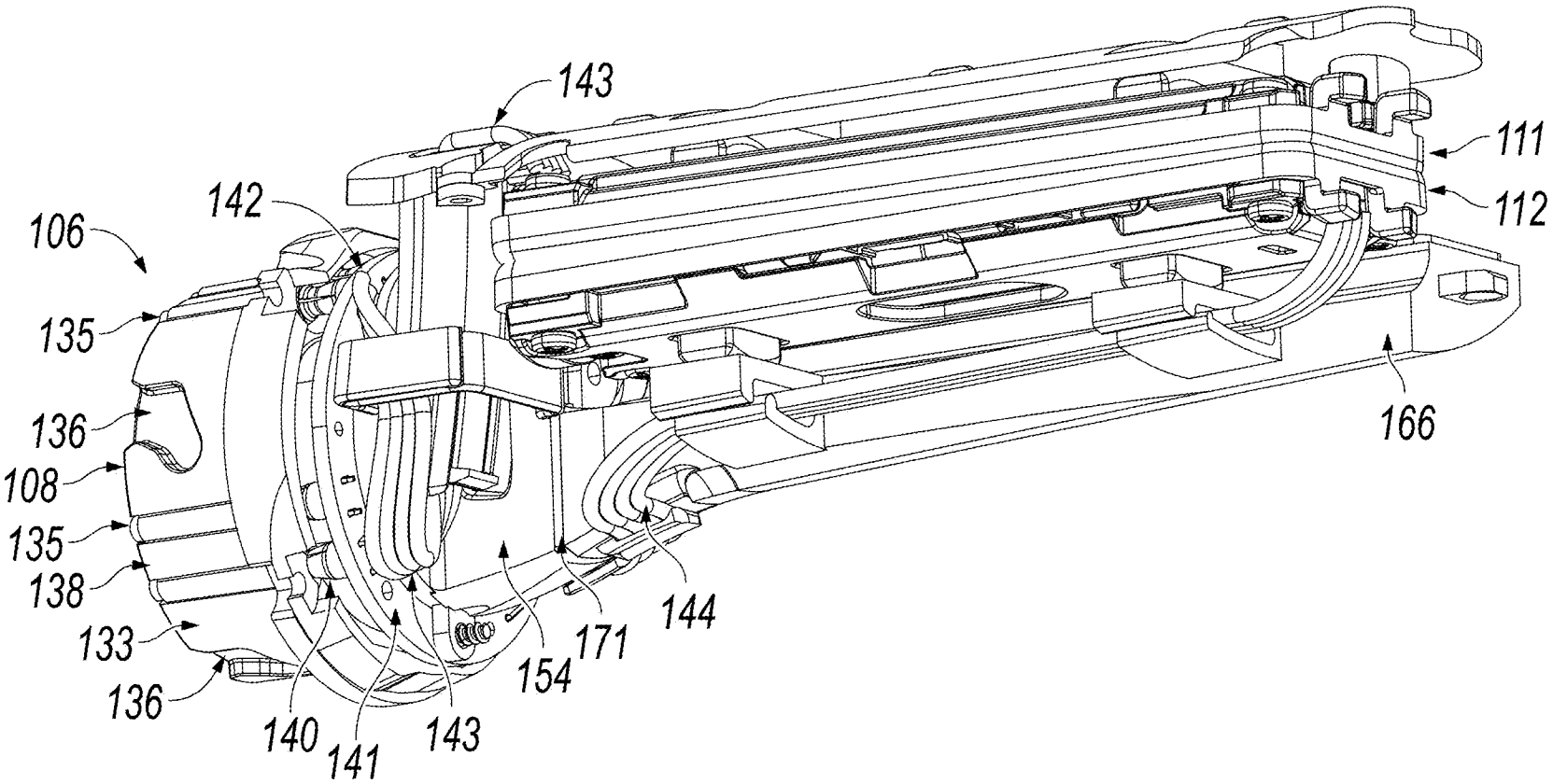
FIG. 5A is a first side perspective of the mating portion of the heated hair straightening accessory of FIGS. 1A-1D with housings of the arm and elongate body removed.
Figure 5B:
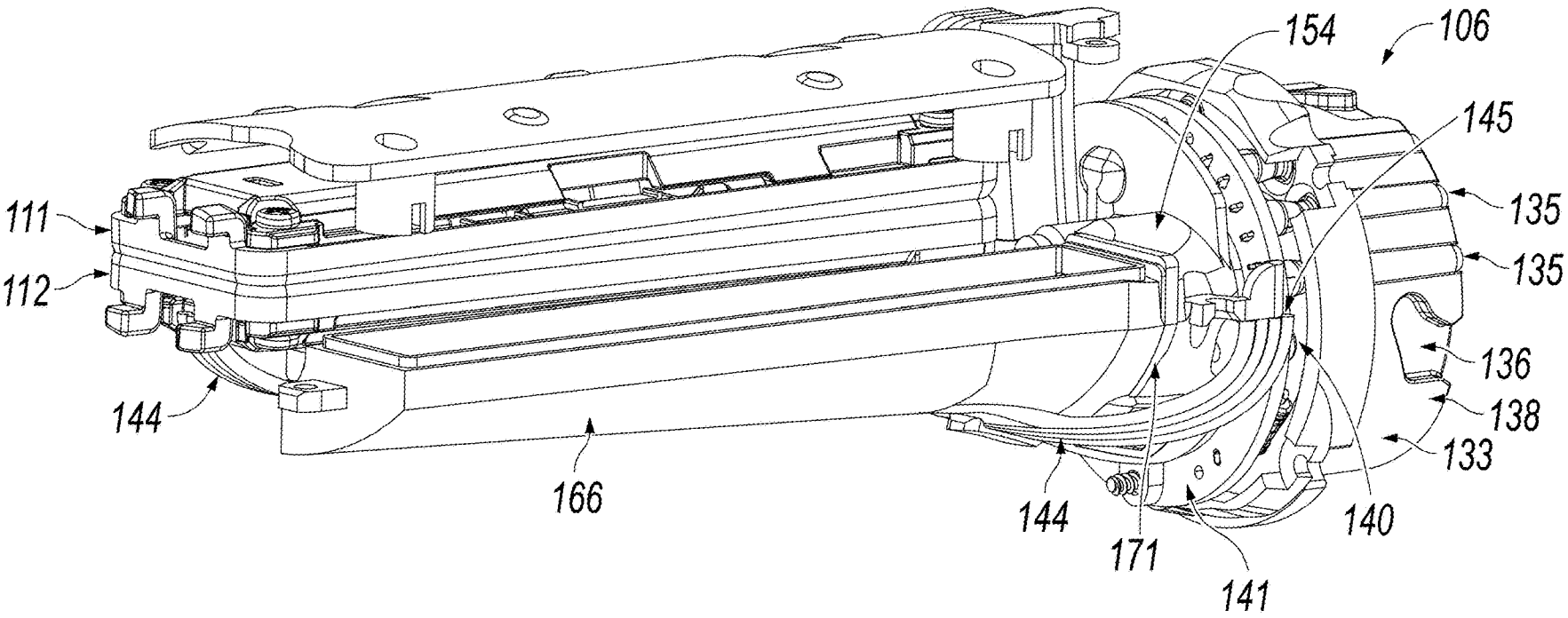
FIG. 5B is a second side perspective of the mating portion of the heated hair straightening accessory of FIGS. 1A-1D with housings of the arm and elongate body removed.

The electrical contacts 135 can extend through the collar 133 from the first end 138 to a second end 140 as shown in FIGS. 5A-5B, which illustrates the mating portion 106 with housings of the arm 104 and the elongate body 103 removed. At the second end 140 of the collar 133, the electrical contacts 135 can be electrically coupled to an annular connector board 141. The annular connector board 141 can include a first portion 142 at which wiring 143 can be coupled to convey power signals to the heater assembly 111 positioned in the arm 104. The annular connector board 141 can further include a second portion 145 at which wiring 144 can be coupled to convey power signals to the heater assembly 112 positioned within arm 132 of the elongate body 103. A variety of locations on the annular connector board 141 can be envisioned for coupling wiring 143, 144 and need not be limited to the locations shown in FIGS. 5A-5B.

Figure 6:
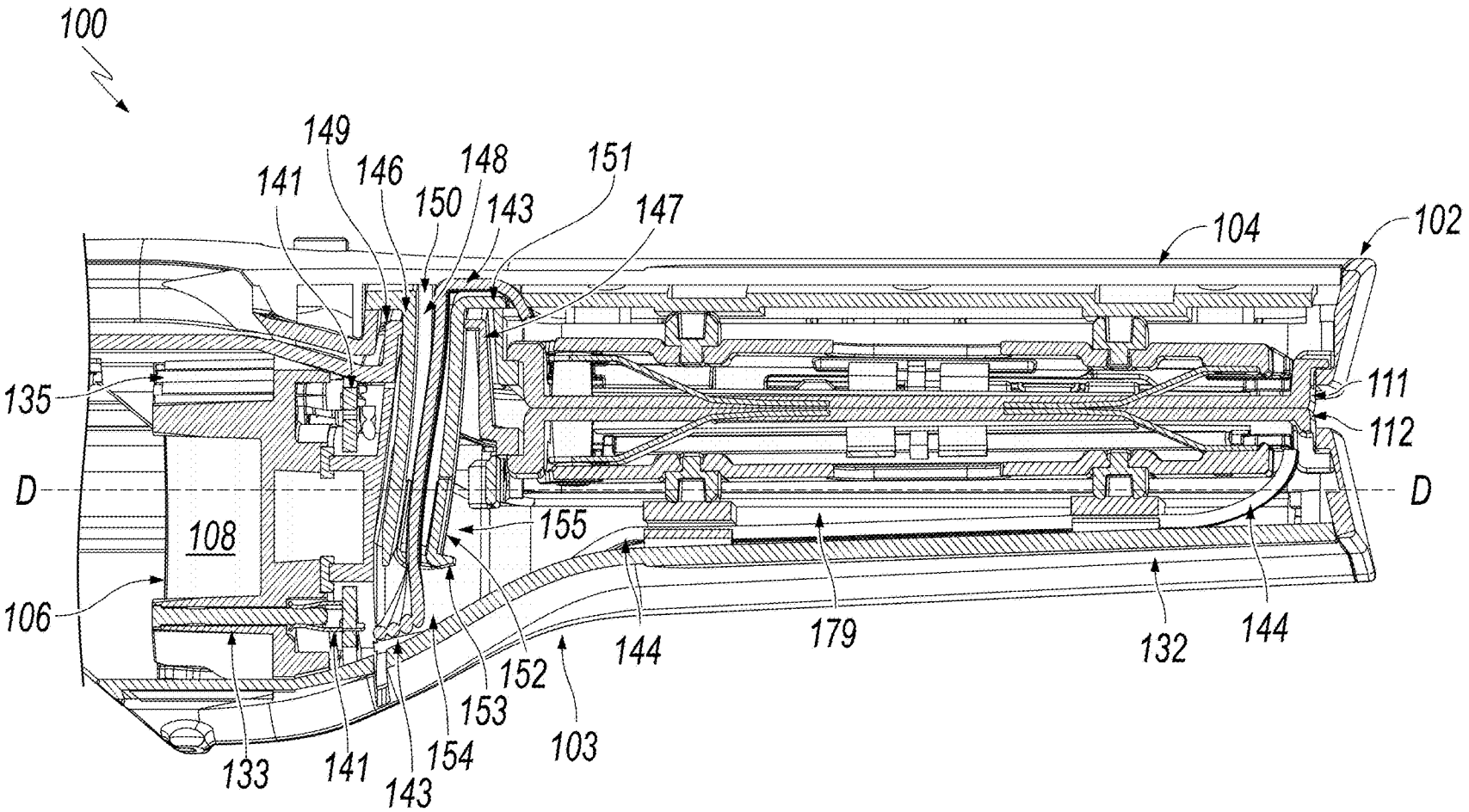
FIG. 6 is a cross-sectional view of the heated hair straightening accessory of FIGS. 1A-1B in the closed position showing the heater assemblies positioned in the arm and the elongate body.
Figure 7:
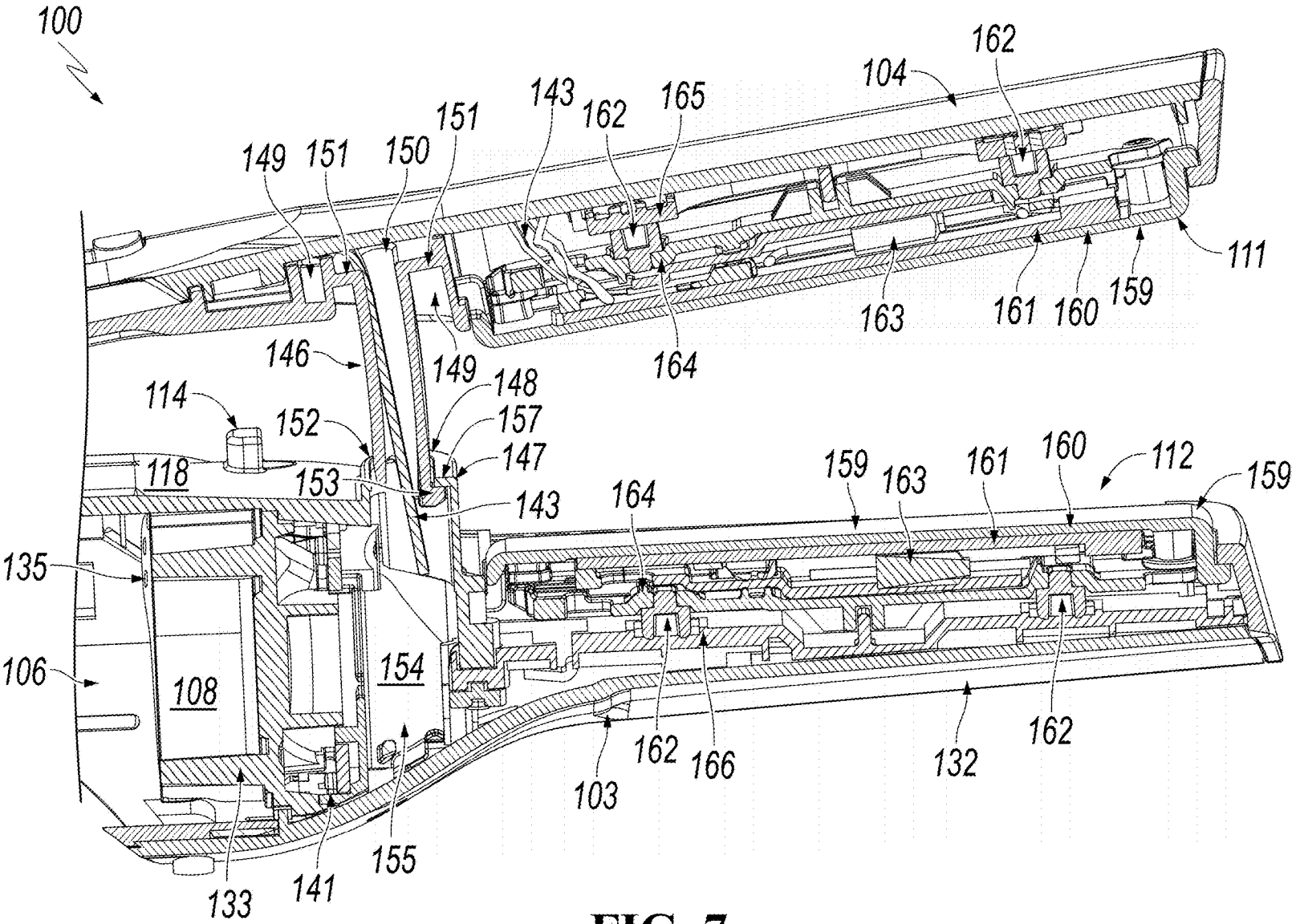
FIG. 7 is a cross-sectional view of the heated hair straightening accessory of FIGS. 1C-1D in the open position showing the heater assemblies positioned in the arm and the elongate body.
Figure 8:
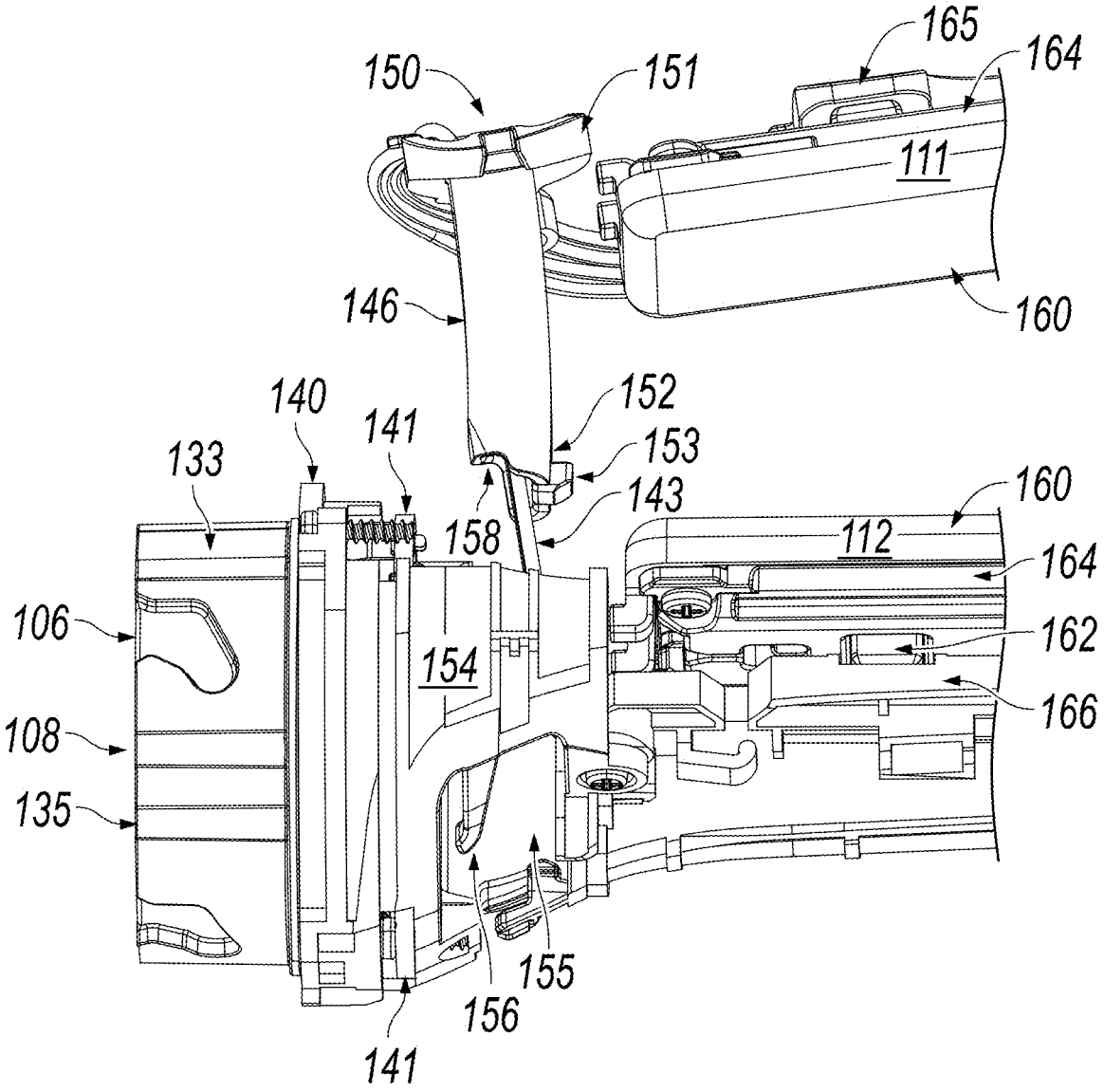
FIG. 8 is side view of the mating portion with housings of the arm and the elongate body removed illustrating a conduit conveying wiring to the heater assembly of the arm of the heated hair straightening accessory of FIGS. 1C-1D in the open position.

The wiring 143 can be conveyed to the heater assembly 111 positioned in the arm 104 from the annular connector board 141 via a cylindrical conduit 146 as shown in FIGS. 6-8. The conduit 146 can protrude from a recess 147 in the arm 104 toward the elongate body 103. For example, the elongate body 103 can include a frame 154 positioned adjacent to the annular connector board 141. The frame 154 can be secured to the heater assembly 112 configured in the arm 132 of the elongate body 103. The frame 154 can have a cavity 155 therein. The conduit 146 can slidably translate into and out of the cavity 155 as the arm 104 is translated from the closed position A shown in FIG. 6 to the open position B shown in FIG. 7.

The conduit 146 can include a first end 150 that can be secured within a recess 149 of the arm 104. The first end 150 can include a flange 151 extending around a circumference of the conduit 146 at the first end 150. The recess 149 can receive a protrusion 147 positioned on the elongate body 103 when the arm 104 is in the closed position A as shown in FIG. 6. The protrusion 147 can include an opening 148 to allow the conduit 146 to slidably translate into and out of the protrusion 147. The second end 152 of the conduit 146 can include a flange 153 configured to limit vertical travel of the conduit 146 out of the opening 148 of the protrusion 147. For example, as shown in FIG. 7, the flange 153 contacts a collar 157 of the protrusion 147 at the opening 148 to restrain the conduit 146 within the protrusion 147 when the arm 104 is moved to the open position B.

The frame 154 can also include a projection 156 projecting into the cavity 155 as shown in FIG. 8. The projection 156 can be configured to abut the second end 152 of the conduit 146 to limit vertical travel of the conduit 146 into the frame 154. For example, the projection 156 can be configured to engage with a notch 158 formed at the second end 152 of the conduit 146 when the arm 104 is moved to the closed position A. Advantageously, the conduit 146 can route the wiring 143 to the heater assembly 111 in the arm 104 without kinking or limiting translation of the arm 104 and without being pulled out of the cavity 155 by virtue of the flange 153 abutting the collar 157 when the arm 104 is moved from the closed position A to the open position B.

Wiring 143 to the heater assembly 111 positioned in the arm 104 can be routed above a longitudinal axis D extending through a center of the mating portion 106 (and the air inlet 108) as shown in FIG. 6. Wiring 144 to the heater assembly 112 positioned in the arm 132 of the elongate body 103 can be routed below the longitudinal axis D. As shown in FIG. 7, each of the heater assemblies 111 and 112 can include a heated hair contacting surface 159. In some embodiments, the hair contacting surface 159 can include a thermally conductive material, such as a ceramic material. The heater assemblies 111, 112 can also include a heating plates 160 on which the hair contacting surface 159 is located. In some embodiments, the heating plates 160 can include a metallic material such as aluminum. The heating plates 160 can be in thermal contact with a heating element 161 included in each of the heater assemblies 111, 112. The heating elements 161 can be electrically coupled to the electrical contacts 135 in the collar 133 via wiring 143, 144 coupled to the annular connector board 141 so that power signals can be received by the hair care appliance when an end of the hair care appliance is received within the collar 133 provided in the mating portion 106. The heater assemblies 111, 112 can also include a thermal fuse 163. The thermal fuse 163 can be electrically coupled to wiring 143, 144 and can provide a thermal cut-off to prevent the heating elements 161 from overheating.

Figure 9:
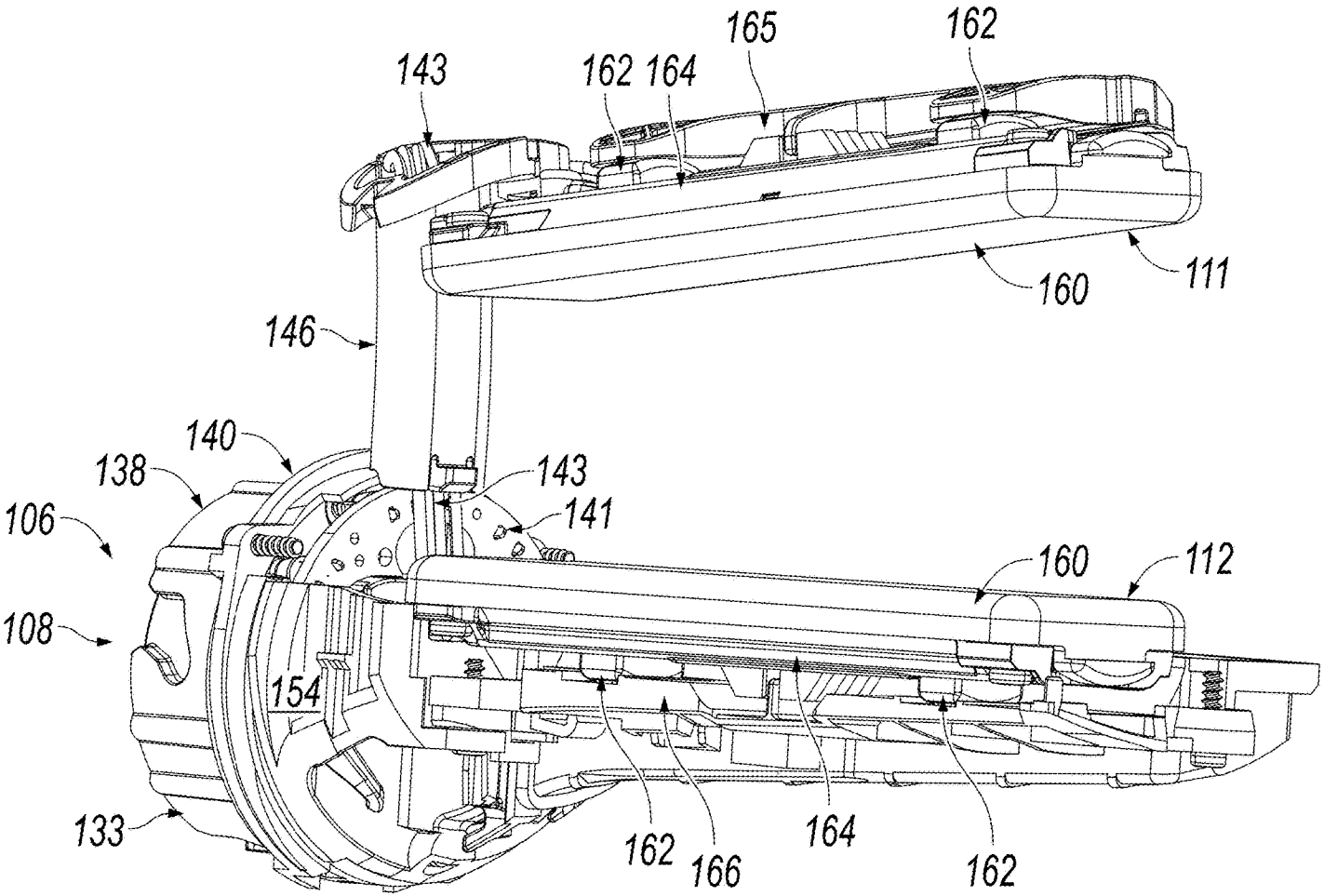
FIG. 9 is a perspective view of the mating portion of FIG. 8 illustrating the heater assemblies of the heated hair straightening accessory of FIGS. 1C-1D in the open position.

The heating plates 160 and the heating elements 161 can be supported by one or more elastic elements 162. The elastic elements 162 can include a rubber or silicone material configured to absorb compressive forces that can be applied to the heater assemblies 111, 112 when hair is clamped therebetween or when excess force is used to close the arm 104 into the closed position A. In other embodiments, the elastic elements 162 can include a spring or similar compressible element. In some embodiments, the elastic element 162 can be configured around the heating plates 160. A first end of the elastic elements 162 can be coupled to a heater assembly frame 164 included in the heater assemblies 111, 112 as shown in FIGS. 7-9. The heater assembly frames 164 and the heating plates 160 can enclose the heating elements 161, the first end of the elastic elements 162 and the thermal fuse 163. A second end of the elastic element 162 can abut an arm frame 165 of arm 104 and a frame 166 that can be coupled to the frame 154 of the mating portion 106 and extends toward the second end 102 of the arm 132 of the elongate body 103. In this way, the heater assemblies 111, 112 can "float" within the arm 104 and elongate body 103, such that the heater assemblies 111, 112 are movably retained therein without being affixed or mounted to an internal structure of the HHSA 100.

Returning to FIGS. 1A-1D and 4, the elongate body 103 can also include an air inlet 108 configured within the shroud 116 of the mating portion 106. The air inlet 108 can be a primary air inlet and can receive a primary airflow F from a hair care appliance when the HHSA 100 is coupled thereto. In some embodiments, the primary airflow F can include heated air which was heated by the hair care appliance. The heated air can be heated to any suitable temperature, as would be appreciated. In other embodiments, the primary airflow F can include non-heated air provided by the hair care appliance. The primary airflow F can pass through the cavities of the hollow frames 154, 166 and can exit the arm 132 as airflow $F^C$ via a plurality of air outlets 110 extending toward the second end 102 of the arm 132. The plurality of air outlets 110 can include a first plurality of air outlets 115A and a second plurality of air outlets 115B. The primary air inlet 108 can be fluidically coupled to the first plurality of air outlets 115A such that the primary airflow F can be received within the primary air inlet 108 from the hair care appliance and can pass through frames 154, 166 to exit the first plurality of air outlets 115A.

The elongate body 103 can include a plurality of secondary air inlets 109 configured at one or more locations on a second surface 119 of the elongate body 103. As shown, the plurality of secondary air inlets 109 are oval shaped, but a variety of other shapes of the air inlets 109 can be envisioned, such as circular or slot shaped air inlets 109. The secondary air inlets 109 can extend along surface 119 of the arm 132 of the elongate body 103 toward the second end 102 thereof. The secondary air inlets 109 can be fluidically coupled to the second plurality of air outlets 115B such that a secondary airflow $F^1$ can be drawn into the air inlets 109, e.g., via entrainment caused by the primary airflow F exiting the first plurality of air outlets 115A, and can exit the second plurality of air outlets 115B. In some embodiments, the secondary airflow $F^1$ can include ambient air surrounding the HHSA 100 having a temperature that is lower than that of the heated air included in the primary airflow F. Thus, the air flow $F^C$ can be the resultant combination of airflows F and $F^1$ and can exit the first and second plurality of air outlets 115A, 115B as the combined airflow $F^C$. The arrangement of the air inlets 109 and the secondary airflow $F^1$ can advantageously cool the second surface 119 of the elongate body 103 for improved handling and reduced risk of burns touching the second end 102 of the HHSA 100.

Figure 10:
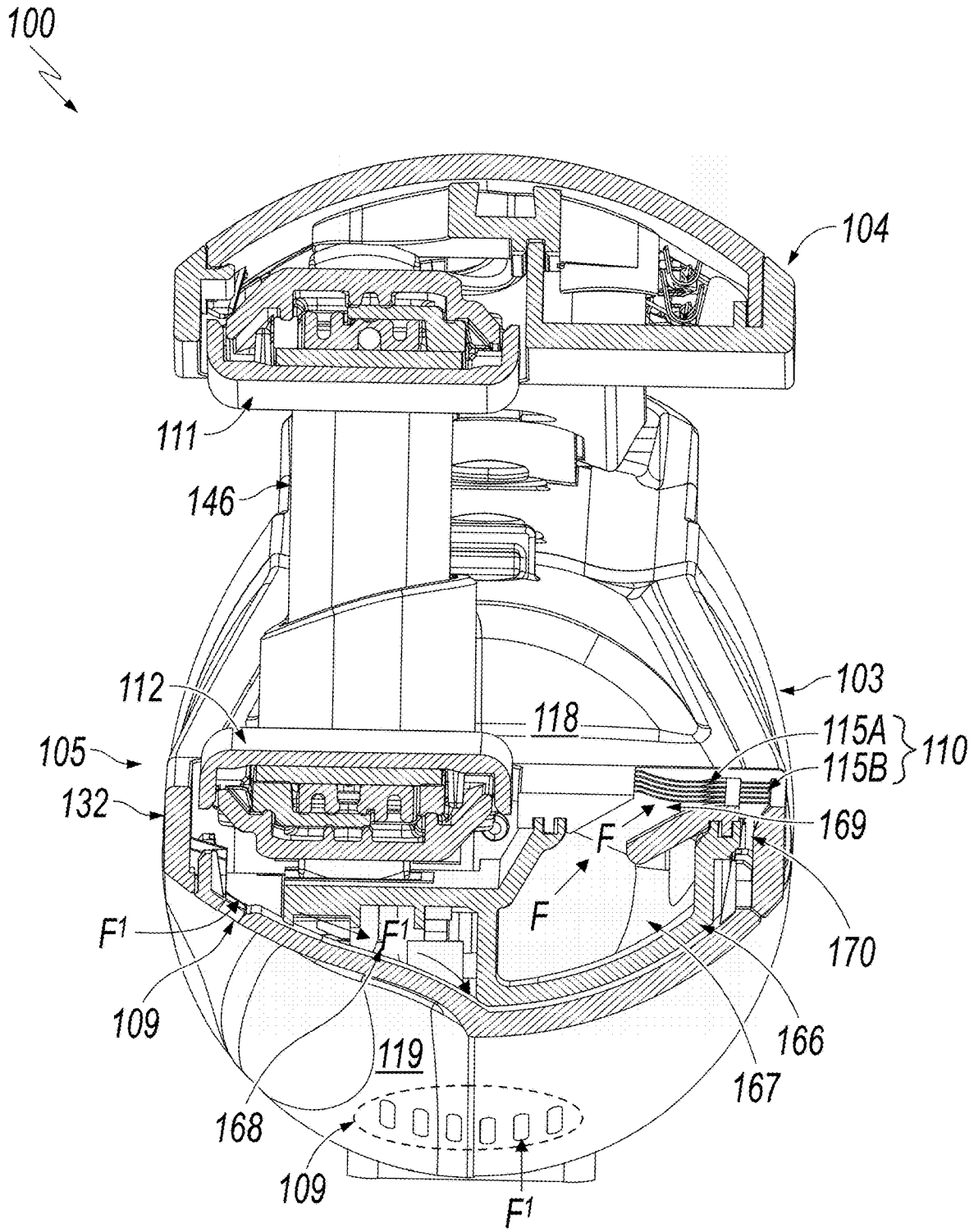
FIG. 10 is a cross-sectional front view of the clamping portion of the heated hair straightening accessory of FIGS. 1C-1D in the open position illustrating an airflow provided via a plurality of air outlets extending along an arm of the elongate body.

With reference to FIGS. 4, 10 and 11, the primary airflow F can be received at the primary air inlet 108 and can engage with a diverter 168 of the frame 154. The diverter 168 can direct the primary airflow F into a cavity 167 of the frame 166. The cavity 167 can be fluidically connected to channels 169 which can convey the primary airflow F out of the first plurality of outlets 115A. The channels 169 can be angled so as to direct the primary airflow F out of the outlets 115A at an angle relative to the surface 118 of the arm 132. A gasket 171 can be positioned between the frame 154 and the frame 166 as shown in FIGS. 5A and 5B. While the figures illustrate the arm 104 as lacking an internal cavity for receiving airflow, such that the primary airflow F only passes through the cavity 167 formed in the arm 132 of the elongate body 103, alternative embodiments are possible in which cavities for receiving airflow and corresponding air outlets are formed in both arms (e.g., arms 132, 104) so that each arm is configured to emit airflow provided by the hair care appliance concurrently into the space between the arms.

The secondary airflow $F^1$ can be received via secondary air inlets 109 positioned on surface 119 of the elongate body 103 (and arm 132) and can pass through a second cavity 179 formed within the elongate body 103 and the arm 132 adjacent to the frame 166 and the heater assembly 112. The second cavity 179 can be fluidically separated from and fluidically sealed from the cavity 167. The second cavity 179 can be formed, at least in part, by a wall of the frame 166 and by the surface 118 of the arm 132. The second cavity 179 can convey the wiring 144 coupling the electrical contacts 135 to the heater assembly 112 positioned in the arm 132 as shown in FIG. 6. The second cavity 179 can extend under the frame 166 and the cavity 167 as shown in FIG. 11. The secondary airflow $F^1$ can pass under the frame 166 to enter channels 170 that are substantially perpendicular to the surface 118 of the arm 132. The secondary airflow $F^1$ can exit the channels 170 in a substantially perpendicular manner relative to the surface 118 of the arm 132.

As illustrated in FIG. 11, a distal end 172 of the channels 169 can be angled and a distal end 173 of the channels 170 can also be angled. The angles of the distal ends 172, 173 of channels 169, 170 can be configured to unify the airflows F and $F^1$ into a combined airflow $F^C$. The orientation of the channels 169 can cause the primary airflow F exiting the plurality of air outlets 115A to create an area of low-pressure at the interface with the secondary airflow $F^1$. The resultant, combined airflow $F^C$, can cause the secondary airflow $F^1$ to be pulled or entrained into the plurality of secondary air inlets 109 for cooling the surface 119 of the arm 132. The angled distal ends 172, 173 can also direct the combined airflow $F^C$ to exit the plurality of outlets 110 in a direction that is substantially parallel to the surface 118 of the arm 132. This can advantageously direct the combined airflow $F^C$ along a length of user's hair.

In use, a user 174 can couple the HHSA 100 to a hair care appliance configured to provide power signals to the HHSA 100 via the collar 133 configured in the mating portion 106. The user 174 can power on the hair care appliance and select a desired airflow setting. The heating elements 111, 112 can receive power signals from the hair care appliance and based on the configured airflow setting, a primary airflow F can be received via the primary air inlet 108. The user 174 can apply the HHSA 100 in the open position B to a proximal end 176 of the user's hair 175 (e.g., at a location close to their head) and can close the arm 104 toward the elongate body 103 (or vice versa) to form the closed position A retaining the hair 175 between the heater assemblies 111, 112 as shown in FIG. 11. The primary airflow F exiting the first plurality of air outlets 115A can combine with the secondary airflow $F^1$ exiting the second plurality of air outlets 115B to form the combined airflow $F^C$. The combined airflow $F^C$ can be directed down toward a distal end 177 of the user's hair 176. The user 174 can slide the HHSA 100 downward toward the distal end 177 of the hair 175 as the heater assemblies 111, 112 provide a heated styling treatment to the hair 175 and the combined airflow $F^C$ provides a drying treatment to the hair 175. The user 174 can then release the hair 175 from being retained between the heater assemblies 111, 112 in the closed position A by allowing the arm 104 to be biased away from the elongate body 103 by action of the biasing mechanism 120 (for example, by releasing their grip on the arm 104 and/or the elongate body 103 slightly) so that the HHSA 100 partially or fully transitions from the closed position A to the open position B. The user 174 can then reposition the HHSA 100 in the open position B at a new location of hair 175 and repeat the process of closing the arm 104 into the closed position A retaining a new portion of hair 175 between the heating assemblies 111, 112 to provide the aforementioned drying and styling treatments.

The HHSA 100 described herein can provide a number of advantages. For example, the HHSA 100 can be secured to a hair care appliance using a linear connection technique that enables power signals to pass through electrical contacts 135 in the mating portion 106 to provide power to the heater assemblies 111, 112. In this way, the HHSA 100 can provide enhanced heated styling treatments, such as straightening the hair. The airflow arrangement of the HHSA 100 can be configured to direct a primary airflow F, received via a primary air inlet 108 from the hair care appliance, through a plurality of primary air outlets 115A and along a length of the user's hair in a manner that enhances drying and styling treatments commonly performed while straightening hair. The primary airflow F can entrain a secondary airflow $F^1$ into secondary air inlets 109, which can flow through a cavity 167 of an arm 132 of the elongate body 103 to cool a surface 119 of the arm 132. In this way, the HHSA 100 can provide an improved handling experience while drying and/or styling hair. The orientation and position of the primary air outlets 115A and the secondary air outlets 115B along the arm 132 can direct a combined airflow $F^C$ more directly along a length of the user's hair, which can improve the user's experience drying and styling hair. Additionally, the locking mechanism 113 can secure the arm 104 adjacent to the elongate body 103 in the closed position A, which can secure the HHSA 100 for storage or travel. The biasing mechanism 120 can enable the HHSA 100 to easily transition between the closed position A and the open position B with minimal effort applied by the user, which can enhance the styling experience of repeatedly opening the arm 104, positioning hair to be retained between the heater assemblies 111, 112, and closing the arm 104 so that the user can then draw the HHSA 100 down along the length of their hair to dry and/or straighten their hair.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. A hair care accessory, comprising:

an elongate body having an appliance mating portion configured to removably couple the elongate body to a hair care appliance, the appliance mating portion having an air inlet configured to receive airflow from the hair care appliance, and a clamping portion having a first heater assembly, and a plurality of air outlets extending longitudinally there along; and an arm coupled to the elongate body, the arm having a second heater assembly, the arm being movable between an open position in which the second heater assembly is spaced from the first heater assembly, and a closed position in which the first and second heater assemblies are configured to clamp hair therebetween.

2. The hair care accessory of claim 1, further comprising a locking mechanism on at least one of the elongate body and the arm, the locking mechanism having a locked position configured to retain the arm in the closed position and an unlocked position in which the arm is configured to move to the open position.

3. The hair care accessory of claim 2, wherein the locking mechanism comprises an actuator positioned on a first surface of the arm, a hook positioned on a second surface of the arm opposite the first surface, and a protrusion extending from the arm and having a recess therein.

4. The hair care accessory of claim 3, wherein movement of the actuator to the locked position is configured to cause the hook to be received in the recess.

5. The hair care accessory of claim 1, further comprising a biasing mechanism positioned between the elongate body and the arm and configured to bias the arm to the open position.

6. The hair care accessory of claim 1, wherein the elongate body includes a first cavity and a second cavity, the first cavity and the second cavity extending longitudinally through the elongate body.

7. The hair care accessory of claim 6, wherein the elongate body further comprises a diverter downstream from the air inlet and configured to divert the airflow into the first cavity.

8. The hair care accessory of claim 1, wherein the air inlet is positioned between the appliance mating portion and the clamping portion.

9. The hair care accessory of claim 1, wherein the appliance mating portion includes a collar having the air inlet positioned therein, the collar having mating features configured to engage with complementary mating features on the hair care appliance.

10. A hair care accessory, comprising:

an elongate body having a first end, a second end, wherein the elongate body includes a collar at a substantial mid-portion between the first end and the second end of the elongate body, the collar being configured to removably couple the elongate body to a hair care appliance and defining an air inlet configured to receive airflow from the hair care appliance, the elongate body having a first heater assembly mounted thereon and a plurality of air outlets extending longitudinally toward the second end of the elongate body;

an arm having a first end and a second end, the first end of the arm being movably coupled to the first end of the elongate body, the arm having a second heater assembly mounted thereon, the arm being movable between an open position in which the second heater assembly is spaced from the first heater assembly, and a closed position in which the first and second heater assemblies are configured to clamp hair therebetween.

11. The hair care accessory of claim 10, wherein the collar is positioned within a hollow cylindrical shroud extending along a length of the substantial mid-portion of the elongate body.

12. The hair care accessory of claim 10, wherein the first heater assembly is positioned on an inner facing surface of the elongate body between the substantial mid-portion and the second end of the elongate body, and the second heater assembly is positioned on an inner facing surface of the arm between the substantial mid-portion and the second end of the arm.

13. The hair care accessory of claim 10, wherein the first heater assembly and the plurality of air outlets extending substantially parallel to one another longitudinally along the elongate body.

14. The hair care accessory of claim 10, wherein the elongate body has a cavity formed therein and extending from the first end of the elongate body along at least a portion thereof, the cavity being configured to seat at least a portion of the arm when the arm is in the closed position.

15. The hair care accessory of claim 10, wherein the plurality of air outlets in the elongate body comprise a first plurality of air outlets and a second plurality of air outlets.

16. The hair care accessory of claim 15, wherein the first and second plurality of air outlets are adjacent to one another and are configured to direct airflow in between the elongate body and the arm.

17. The hair care accessory of claim 15, further comprising a plurality of air inlets in the elongate body, wherein airflow from the first plurality of air outlets is configured to draw airflow in through the plurality of air inlets and out the second plurality of air outlets.

18. The hair care accessory of claim 10, wherein the collar includes at least one electrical contact thereon configured to electrically couple to an electrical contact on the hair care appliance to allow power to be delivered to the first heater assembly and the second heater assembly.

19. The hair care accessory of claim 10, wherein the arm is substantially planar.

20. The hair care accessory of claim 10, wherein a width of a first portion of the arm extending from the first end of the arm to the substantial mid-portion is less than a width of a second portion of the arm extending from the substantial mid-portion to the second end of the arm.

* * * * *